US006056460A

United States Patent [19]

Suzuki

[11] Patent Number: 6,056,460

[45] Date of Patent: May 2, 2000

[54] PRINTER

[75] Inventor: Kanji Suzuki, Shizuoka, Japan

[73] Assignee: Star Micronics Co., Ltd., Shizuoka, Japan

[21] Appl. No.: 08/995,160

[22] Filed: Dec. 19, 1997

[30] Foreign Application Priority Data

Dec. 25, 1996 [JP] Japan ..... 8-357020

[51] Int. Cl.[7] ..... B41J 11/26

[52] U.S. Cl. ..... 400/621; 400/582

[58] Field of Search ..... 400/621, 621.1, 400/582, 593

[56] References Cited

U.S. PATENT DOCUMENTS

| | | | |
|---|---|---|---|
| 4,216,719 | 8/1980 | Flaceliere et al. | 400/621 X |
| 4,572,686 | 2/1986 | Tanaka | 400/621.1 |
| 4,925,325 | 5/1990 | Niikawa | 400/582 |
| 5,041,845 | 8/1991 | Ohkubo et al. | 400/621 X |
| 5,109,255 | 4/1992 | Nishikawa et al. | 399/70 |
| 5,215,393 | 6/1993 | Wincent | 400/621 |
| 5,478,161 | 12/1995 | Suzuki et al. | 400/621 X |
| 5,588,762 | 12/1996 | Suzuki | 400/621 X |
| 5,649,776 | 7/1997 | Sugimoto et al. | 400/621 X |

FOREIGN PATENT DOCUMENTS 5-155118 6/1993 Japan .

*Primary Examiner*—Edgar Burr
*Assistant Examiner*—Minh H. Chau
*Attorney, Agent, or Firm*—Whitham, Curtis & Whitham

[57] ABSTRACT

A paper discharging apparatus comprising a printing means to perform a predetermined printing on a paper, a cutting means to cut the printed paper at a predetermined length, a paper discharging means to discharge the printed and cut paper through a paper discharging route and a paper outlet, a paper detecting means provided at the paper discharging route to detect the paper, a paper collection part provided between the cutting means and the paper discharging means, and a retry means, to recognize an occurrence of paper jam when the paper is not detected by the paper detecting means in spite of completion of the printing and cutting, to return the paper in a direction opposite to the paper discharging direction and to execute a paper reissue operation, thereby the returned paper being pushed by a reissued paper to be collected in the paper collection part.

10 Claims, 31 Drawing Sheets

PRINTER

BACKGROUND OF THE INVENTION

1. Field of the Invention

The present invention relates to a paper discharging apparatus which is mounted to a paper outlet of a printer, etc., to be used for discharging of paper such as a receipt, ticket. More particularly, the present invention relates to a paper discharging apparatus which, when jamming of paper occurs, automatically detects such a jamming and collects the jammed paper, so that the reissue of paper may be carried out.

2. Description of the Related Art

There are several kinds of cash dispenser (CD) or information output terminal installed in the unmanned shop, etc., in which an apparatus to print and issue the necessary receipt or ticket is provided as a communication means with a customer. This kind of issuing apparatus includes a printer therein so that paper may be printed and interlockingly be discharged. When the printing has been completed, the paper to be issued as receipt or ticket is then cut at a predetermined length by an auto-cutter, and finally the paper is discharged outside by a paper discharging apparatus.

However, there has been existing a problem with regard to the apparatus as above described structure. Namely, in the above described structure, when there is any trouble in the printer, the printer becomes an error state, by which a transaction is suspended, and the customer will then have to wait for a long time until the apparatus recovers. As the possible occurrence of trouble with regard to the printer, there has been known a "jamming of paper (the clogged state with paper)."

As above described, when the receipt is issued, the paper is firstly pulled out of a paper roll into the printer. The pulled paper is conveyed to the printing part, at which the predetermined printing is carried out. The printed paper is then conveyed to the cutting part, at which the paper is cut at a predetermined length by the auto-cutter. The paper is then discharged as a receipt from a discharging outlet via a discharging means.

This kind of discharging apparatus has been disclosed in the prior art, for example, such as the apparatus of U.S. Pat. No. 5,215,393. According to U.S. Pat. No. 5,215,393, as illustrated in FIG. 30, when a paper 105 is conveyed from a cutting part 101 to a discharging part 103, the top of the paper 105 is held by a pair of discharging rollers 107 and 109.

However, it should be taken into account that this kind of discharging apparatus may be installed in various locations regardless of indoor or outdoor, and there may be a case that the apparatus is used under high-temperature and high-humidity condition (for example, above temperature of 43° C. and humidity of 90%). When the apparatus is used under such a bad ambient condition, the paper 105 may absorb moisture and become limp, thus the paper may curl or the top of the paper may crease according to the shape of conveying route or guide of paper. In such cases, the discharging rollers 107 and 109 cannot hold the paper 105, eventually the jamming of paper occurs.

FIG. 31 illustrates a state that the paper 105 becomes limp and curls, thus the discharging rollers 107 and 109 cannot hold the paper 105. FIG. 32 shows a state that creases 105*a* emerge on the paper 105. In these cases, the discharging rollers 107 and 109 cannot hold the paper 105. There is also a state as shown in FIG. 33 that the paper curls according to the shape of guide. As illustrated in FIG. 33, the paper 105 which is pulled out of a roller 104 is guided and conveyed by a guide roller 111. At that time, a curl 105*b* is given on the paper 105 due to the guide roller 111 (as shown in FIG. 34), and because of existence of the curl 105*b*, the discharging rollers 107 and 109 cannot hold the paper 105.

When the paper 105 cannot be held by the discharging rollers 107 and 109, the jamming of paper will occur, which results in the above-mentioned error state of the printer. Eventually the customer will have to wait for a long time until the printer recovers.

SUMMARY OF THE INVENTION

It is an object of the present invention to provide a paper discharging apparatus which can resume the normal state when the jamming of paper occurs, without suspending the issue operations after the occurrence of jamming of paper.

To achieve the object mentioned above, according to the present invention, there is provided a paper discharging apparatus comprising a printing means to perform a predetermined printing on paper, a cutting means to cut the printed paper at a predetermined length, a paper discharging means to discharge the printed and cut paper through a paper discharging route and a paper outlet, a paper detecting means provided at the paper discharging route to detect paper, a paper collection part provided between the cutting means and the paper discharging means, and a retry means, to recognize an occurrence of paper jam when paper is not detected by the paper detecting means in spite of completion of the predetermined printing by the printing means and the cutting by the cutting means, to return paper in a direction opposite to the paper discharging direction, and to execute a paper reissue operation, thereby pushing the returned paper by a reissued paper in order to collect the returned paper in the paper collection part.

With this structure, when paper is detected by the paper detecting means after completion of the predetermined printing by the printing means and cutting by the cutting means, a paper discharging operation may be executed by the paper discharging means, and after the paper discharging operation, when paper is still detected by the paper detecting means after passing of a predetermined time, paper may be returned in a direction opposite to the paper discharging direction to be collected in the paper collection part.

Preferably, the retry means may issue the same paper as ordinarily issued in the reissue operation.

Preferably, the retry means may issue a dummy paper of which length is longer than that of paper ordinarily issued in the reissue operation.

Preferably, the retry means may repeat the paper reissue operation until paper is normally discharged.

Preferably, the retry means may repeat a dummy paper reissue operation until the dummy paper is issued in a normal state.

Preferably, when the dummy paper is detected by the paper detecting means, issue of an ordinary paper may be considered to be possible and issue of the ordinary paper may be carried out, and when the dummy paper is not detected by the paper detecting means, issue of the ordinary paper may be considered to be impossible and issue of the dummy paper may be repeated.

Preferably, the retry means may repeat forward and reverse rotations of discharge rollers in order to press a returned dummy paper toward the paper collection part.

Further, the paper discharging apparatus may be attached to a paper outlet of printer in order to issue receipts, tickets, etc.

In the prior art, when paper becomes limp and creases due to high-temperature and high-humidity environment, the apparatus has been trying to somehow insert the paper in the discharging means. To the contrary, according to the present invention, there is no concept of such troublesome insert of paper, and when the jamming of paper occurs in such an environment, the paper is returned in the direction opposite to the paper discharging direction, and the reissue of paper is carried out, so that the returned paper may be collected in the paper collection part and at the same time the paper may be issued in a normal state.

Therefore, according to the paper discharging apparatus of the present invention, the retry operation is repeated until the normal discharging is carried out, and the next operation should be executed after confirming the normal discharging. Thus the receipts or tickets which could not be discharged in a normal state are collected in a collection part, and such an error discharging receipt or ticket can be reissued in a normal state. Therefore the suspension of issue of receipt due to the jamming of paper will not occur.

Especially in such an operation, since there is a function that the receipt once returned is pressed down toward the collection part by the top of the reissued paper, the returned receipt is sure to be conveyed toward the collection part.

Further, even when the normal discharge cannot be carried out, the receipt can be reissued without fail by repeating the reissue operation, so that the issue operation after that can normally be carried out without fail.

Further, when the dummy receipt longer than the ordinary receipt is issued, the reliability of collection of the returned receipt improves.

Further, when the discharging rollers repeat forward and reverse rotations at issue of the dummy receipt, the reliability of collection of the returned foregoing receipt also improves.

BRIEF DESCRIPTION OF THE DRAWINGS

The invention will be described below in detail with reference to the accompanying drawings, in which.

DETAILED DESCRIPTION OF THE INVENTION

First Embodiment

A first embodiment of the present invention will now be described with reference to FIGS. 1 through 23. Firstly, the partial structure of a printer including a paper discharging apparatus according to the present embodiment is described with reference to FIG. 1.

Figure 1:
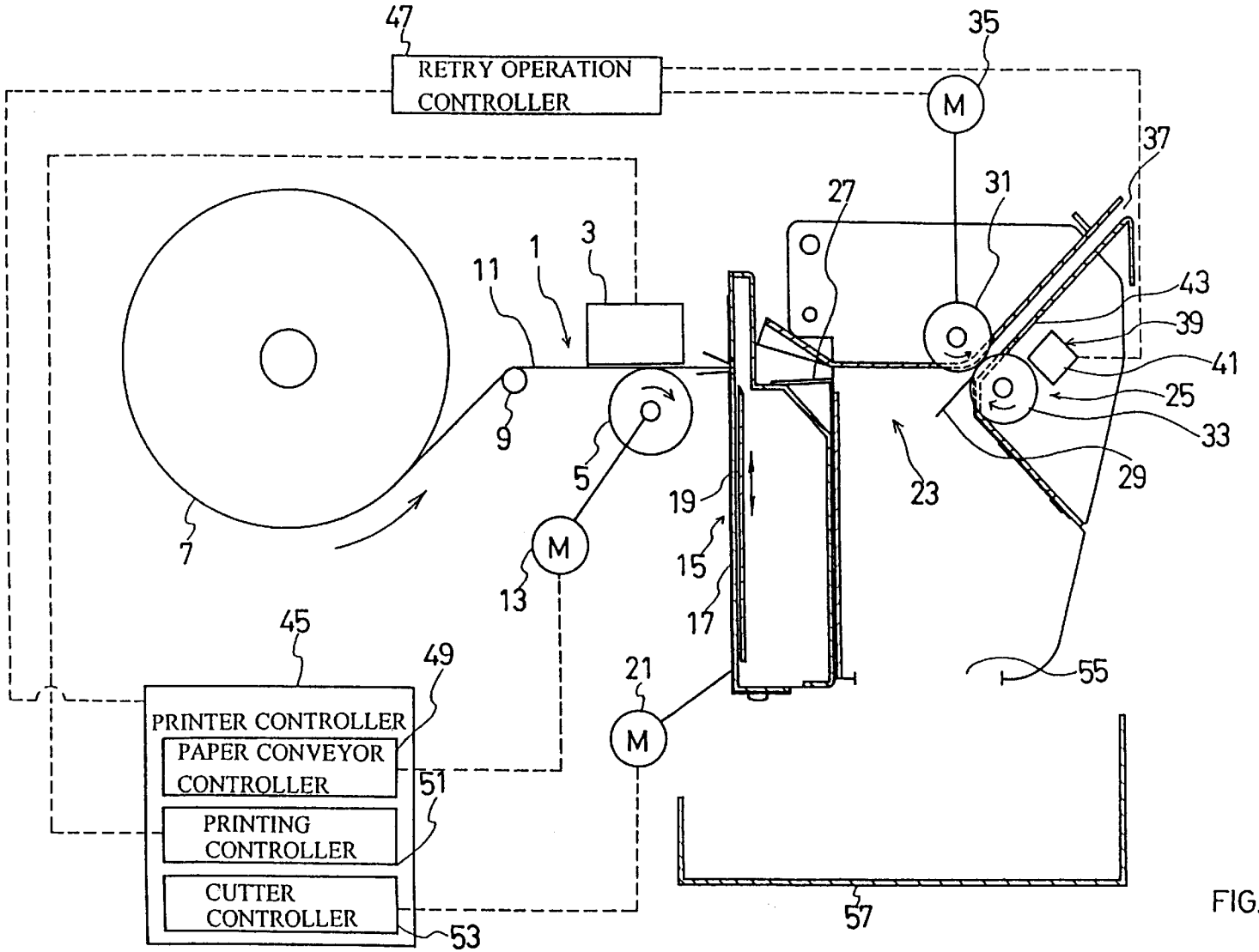
FIG. 1 is a view with a block diagram showing a structure of a printer including a paper discharging apparatus according to a first embodiment of the present invention.
Figure 2:
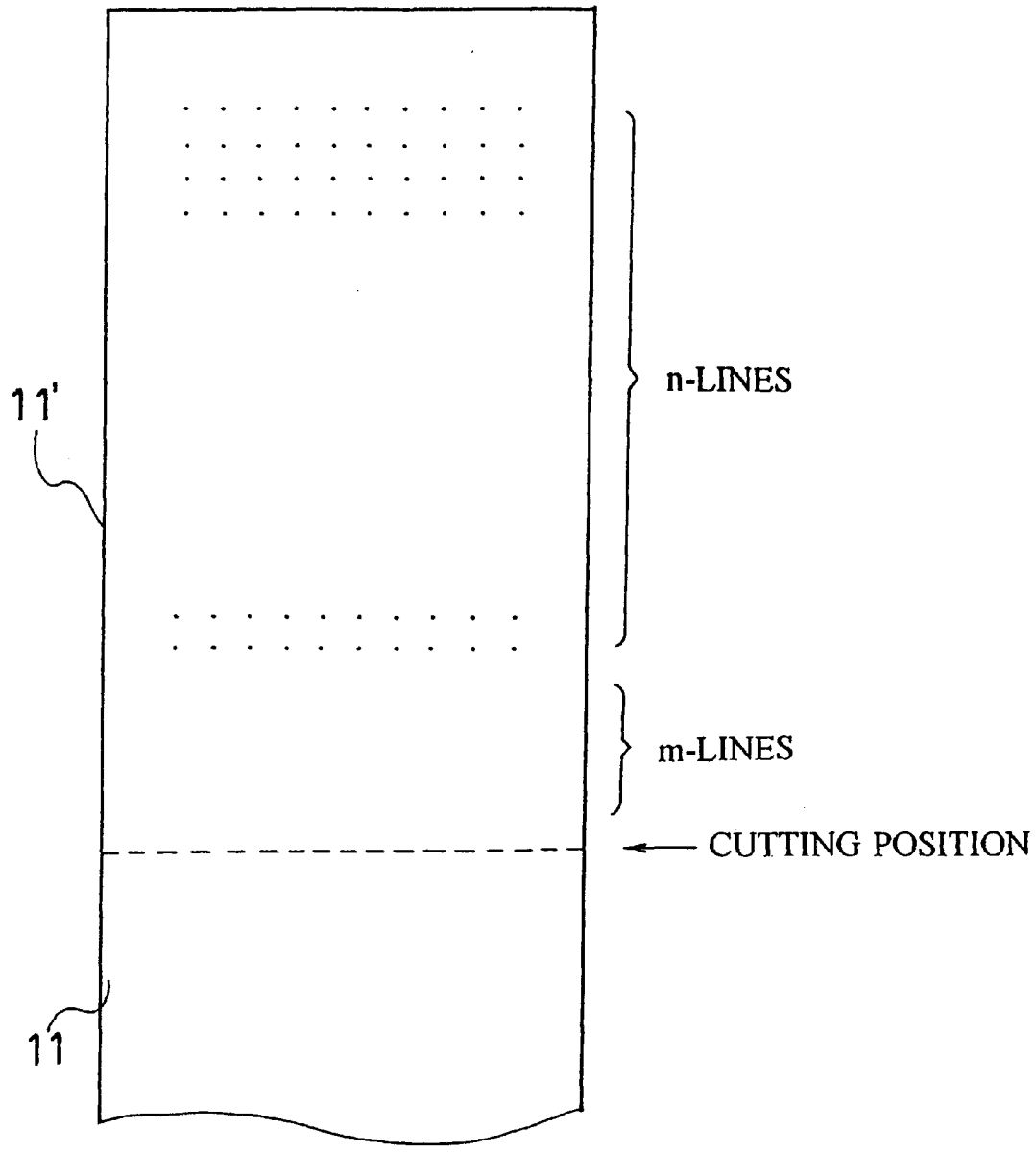
FIG. 2 is a plan view showing a receipt according to the first embodiment of the present invention.

As shown in FIG. 1, there is a printing means 1 which comprises a printing head 3, a platen 5, etc. The printing means 1 performs a predetermined printing on a paper 11, which is pulled out of a paper roll 7 and supplied to the printing means 1 through a guide of a guide roller 9. The platen 5 is rotatively driven by a driving motor 13. The paper 11 on which the predetermined printing has been carried out by the printing means 1 is then conveyed to a cutting means 15. The cutting means 15 comprises a housing 17, a cutter 19 which is provided and makes reciprocating movement inside the housing 17, a driving motor 21 which reciprocates the cutter 19, etc. The paper 11 is cut by the cutting means 15 at a predetermined length, thus a receipt 11 as shown in FIG. 2 is issued.

The paper 11 is guided by a guide means 23 and conveyed to a paper discharging means 25. The guide means 23 comprises a guide plate 27 provided beyond the cutting position of the cutting means 15, and another guide plate 29 provided in the paper discharging means 25. The paper 11 is guided by the guide plate 27 and then transferred to the guide plate 29, so as to span each guide plate. The paper 11 is then guided and conveyed to the paper discharging means 25 by the guide plate 29.

The paper discharging means 25 is provided with a pair of discharging rollers 31 and 33. One of the discharging rollers, in this case the discharging roller 31, is rotatively driven by a driving motor 35. The paper 11 which has been guided by the guide plate 29 is then held by the pair of discharging rollers 31 and 33, and finally is discharged via a discharging outlet 37.

There is a paper detecting means 39 provided along the paper discharging route in the paper discharging means 25. The paper detecting means 39 comprises a paper sensor 41 and a paper detecting opening 43, so that the paper 11 (the receipt 11') may be detected by an optical method.

It is of course clear that the method of detecting is not limited to the optical method, and any detecting method that is known per se can be applied to.

The structure of a controlling means will now be described. In summary, the controlling means comprises a printer controller 45 and a retry operation controller 47 (also known as a controlling means). The printer controller 45 is provided with a paper conveyor controller 49, a printing controller 51 and a cutter controller 53. The paper conveyor controller 49 controls the driving motor 13 which rotatively drives the platen 5. The printing controller 51 controls the printing head 3. The cutter controller 53 controls the driving motor 21 which reciprocates the cutter 19. Further, the retry operation controller 47 controls the driving motor 35 which rotatively drives the paper discharging roller 31. In addition, the retry operation controller 47 receives the signal from the paper sensor 41 of the paper detecting means 39.

There is an opening 55 below the space between the guide plates 27 and 29 of the guide means 23, and a collection tray 57 is provided still below the opening 55. A paper collection part consists of the opening 55 and the collection tray 57.

The operation of the apparatus according to the present embodiment will now be described on the basis of the above structure.

Figure 3:
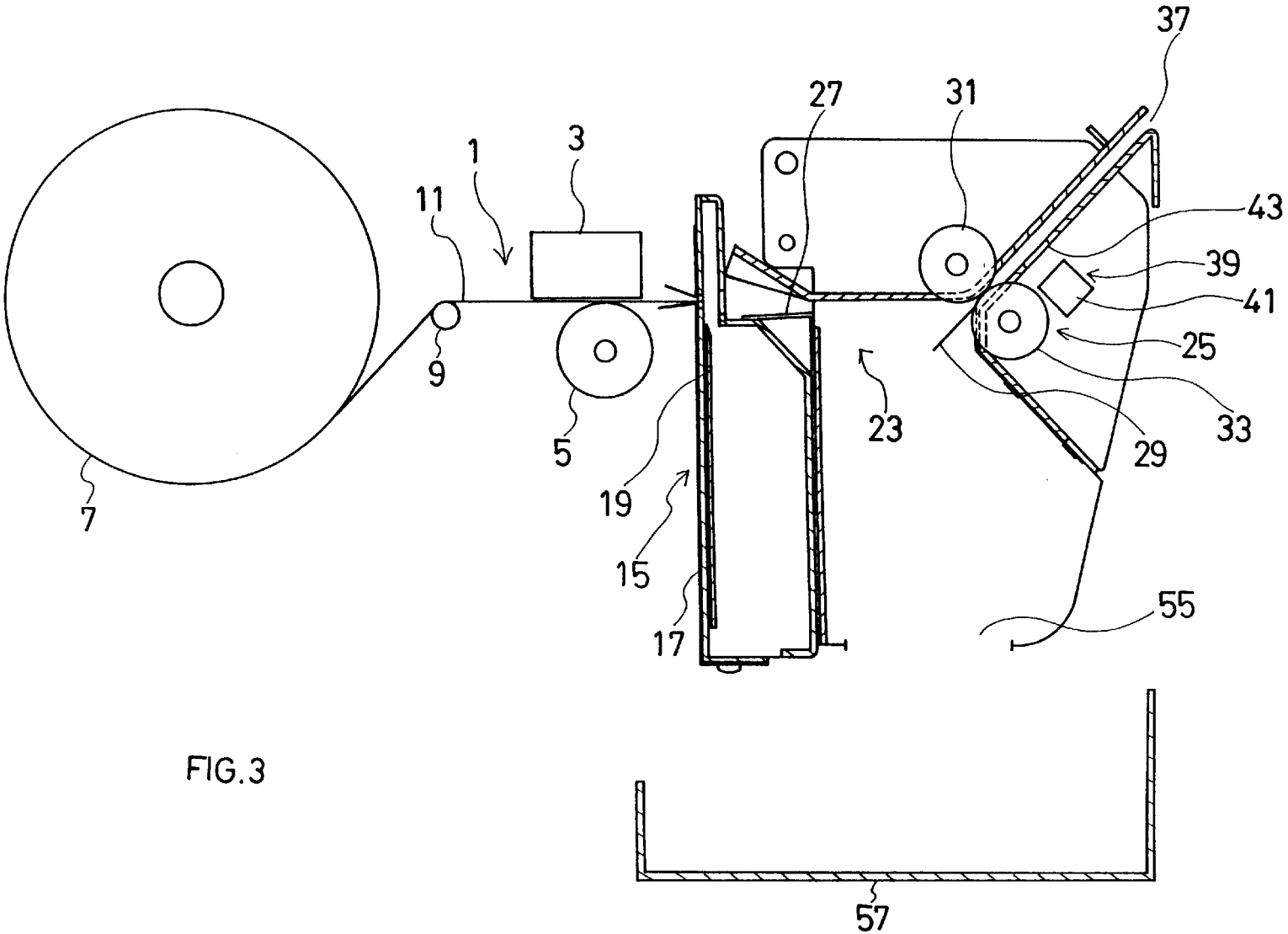
FIG. 3 is a view showing an operation of the paper discharging apparatus according to the first embodiment of the present invention.
Figure 4:
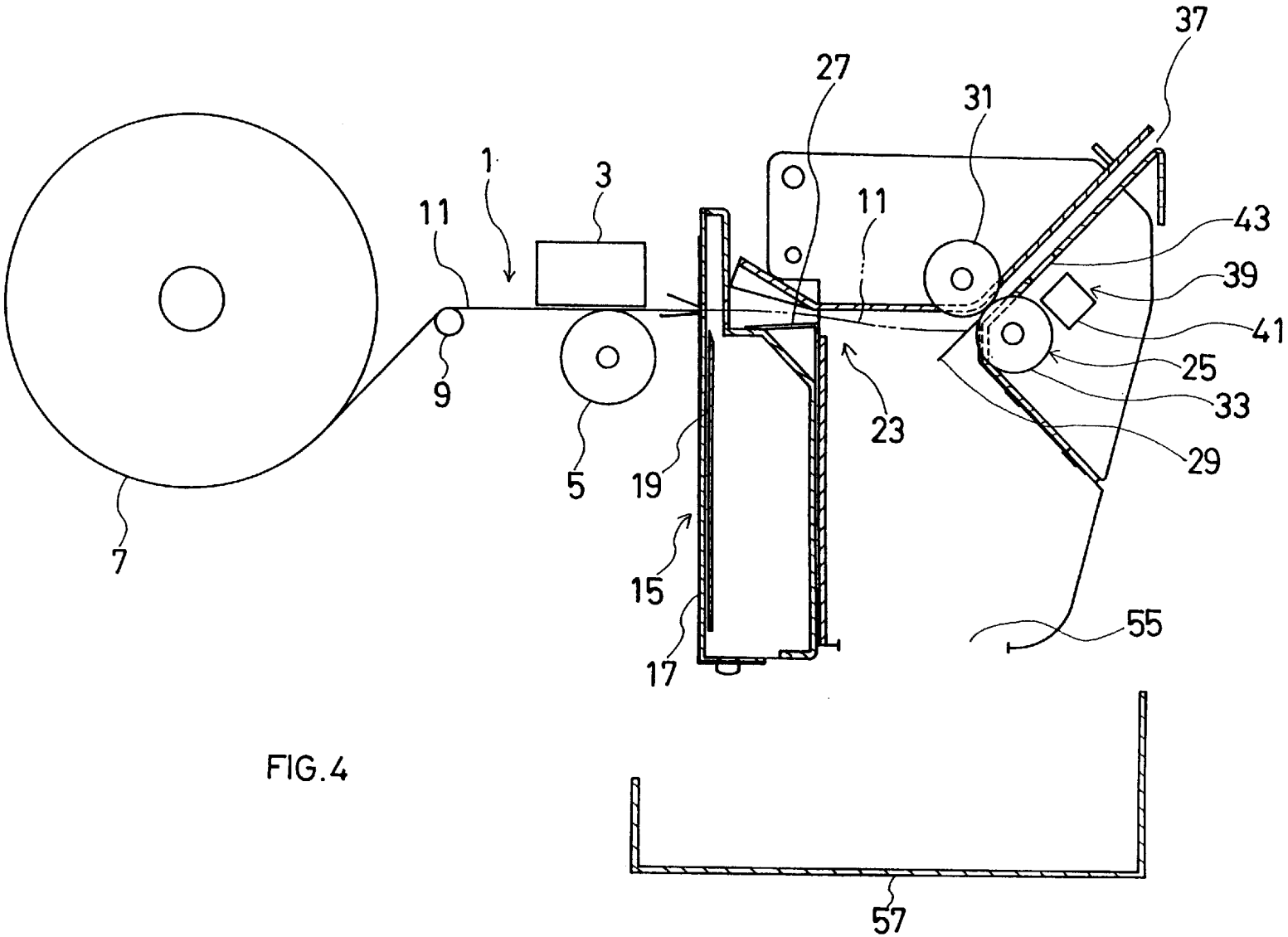
FIG. 4 is a view showing an operation of the paper discharging apparatus according to the first embodiment of the present invention.
Figure 5:
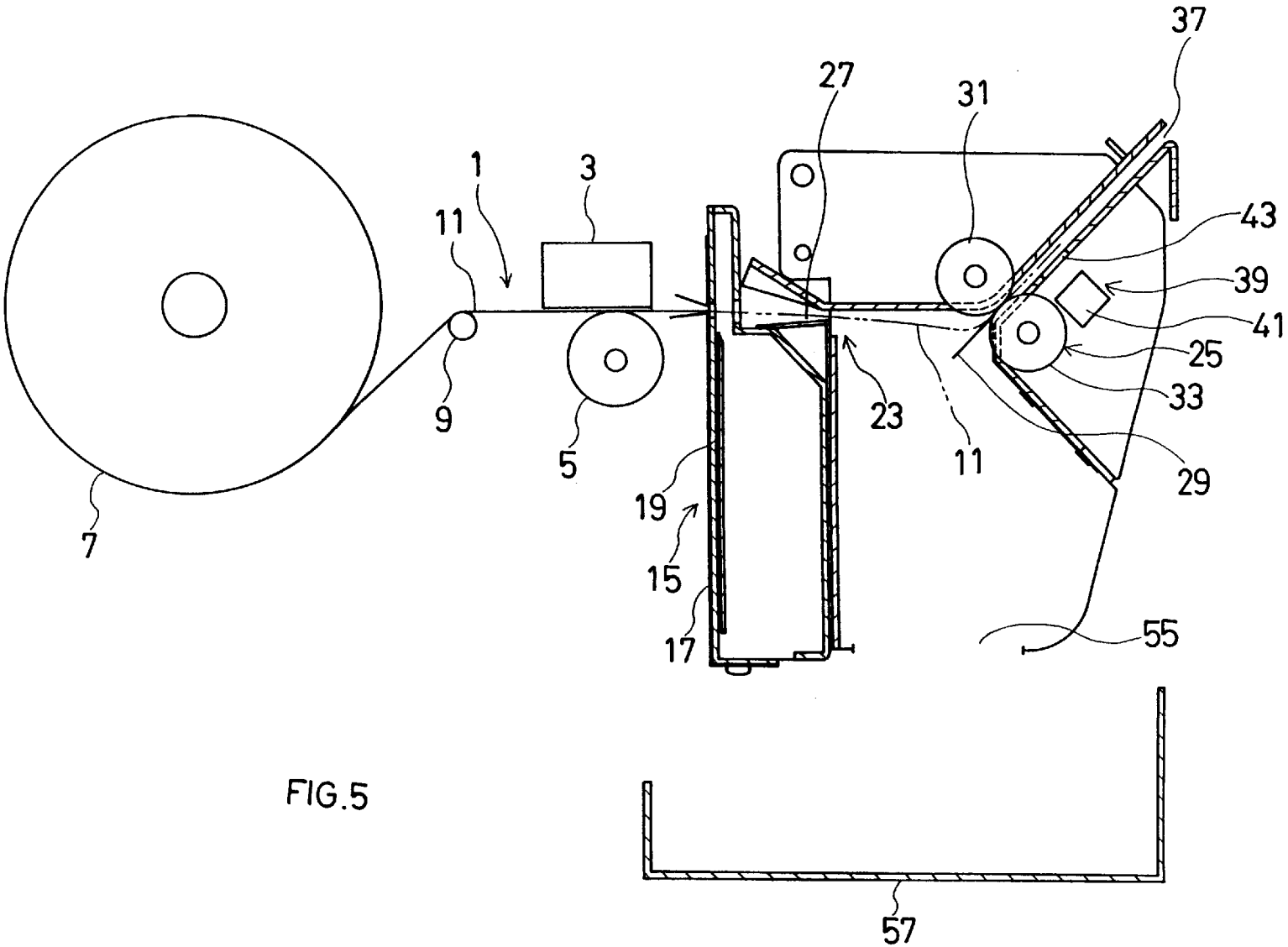
FIG. 5 is a view showing an operation of the paper discharging apparatus according to the first embodiment of the present invention.

As illustrated in FIG. 3, the top end of the paper 11 is firstly in a stand-by state in front of the cutting position of the cutting means 15 (namely, on the side of the printing means 1 in FIG. 3). After that, the paper 11 is conveyed toward the cutting means 15 with the predetermined printing being printed thereon by the printing means 1, which is shown in FIG. 4. The top of the paper 11 is then guided by the guide plates 27 and 29 of the guide means 23, so that the top thereof may be guided to insert between the pair of discharging rollers 31 and 33 of the paper discharging means 25. When the paper 11 is further conveyed, the top thereof is held by the pair of the discharging rollers 31 and 33 to allow the discharge of the paper 11. Afterwards, the top of the paper 11 is detected by the paper sensor 41 as shown in FIG. 5, at that time the discharge operation of the pair of the discharging rollers 31 and 33 halts.

Figure 6:
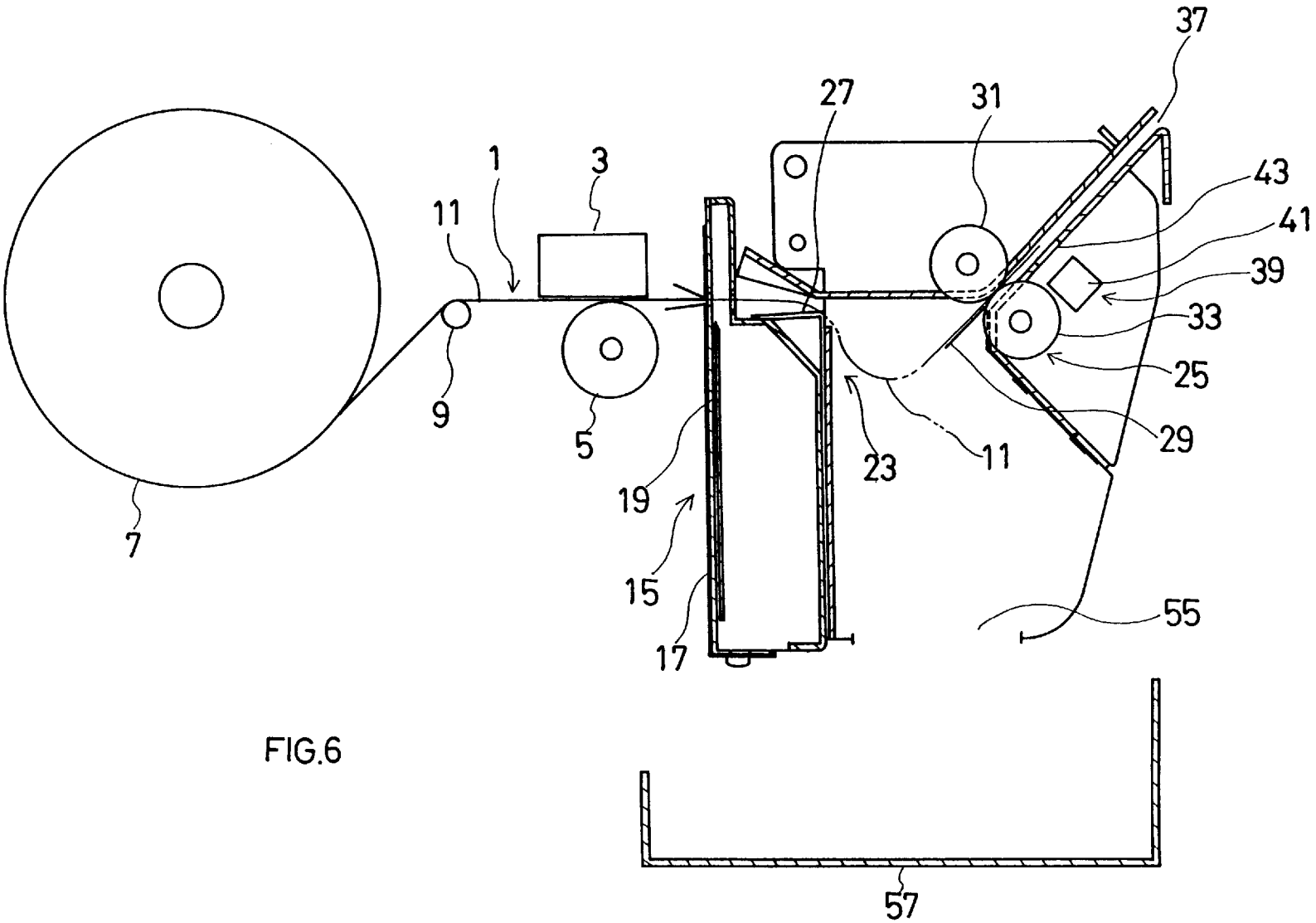
FIG. 6 is a view showing an operation of the paper discharging apparatus according to the first embodiment of the present invention.
Figure 7:
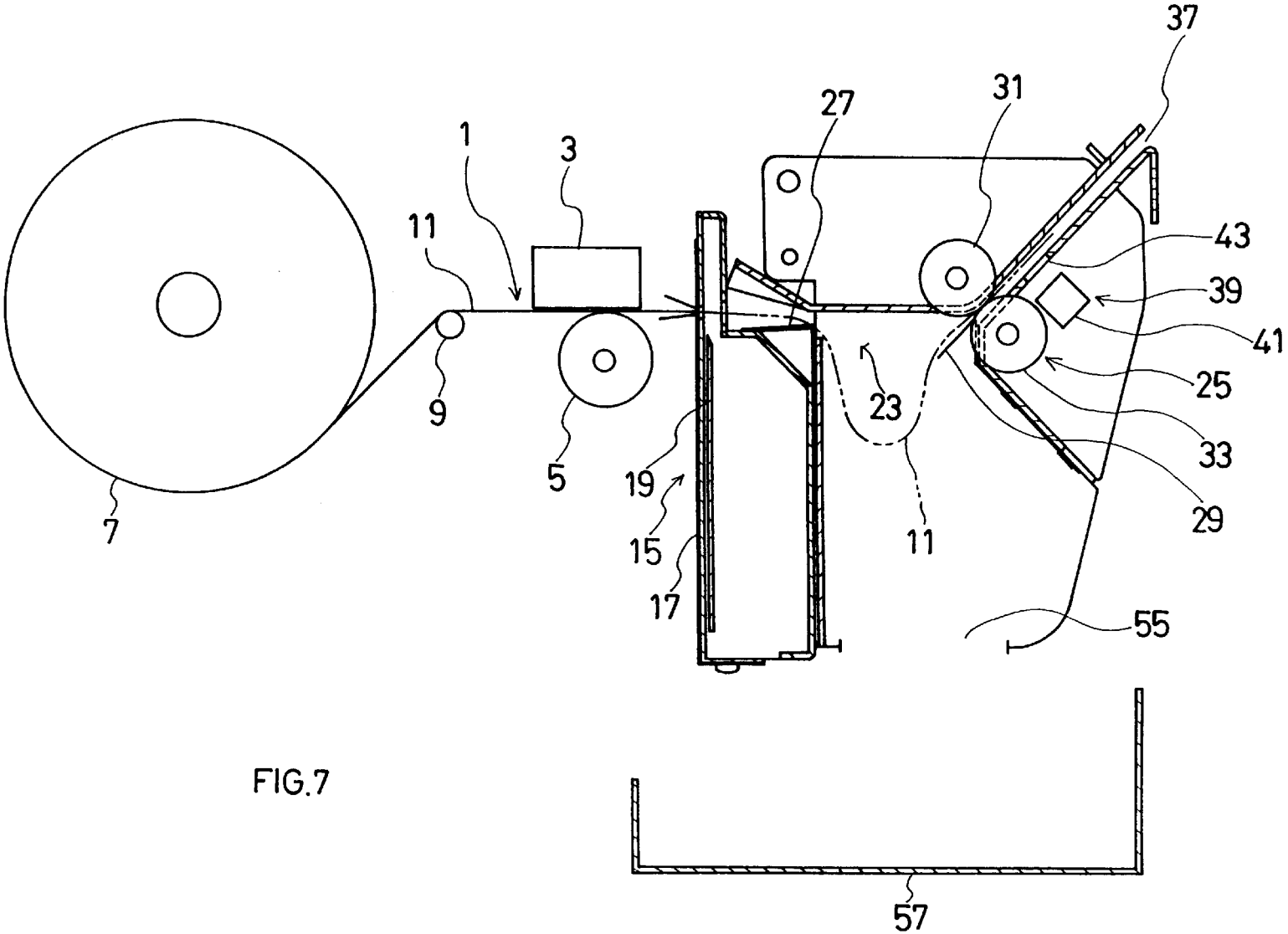
FIG. 7 is a view showing an operation of the paper discharging apparatus according to the first embodiment of the present invention.
Figure 8:
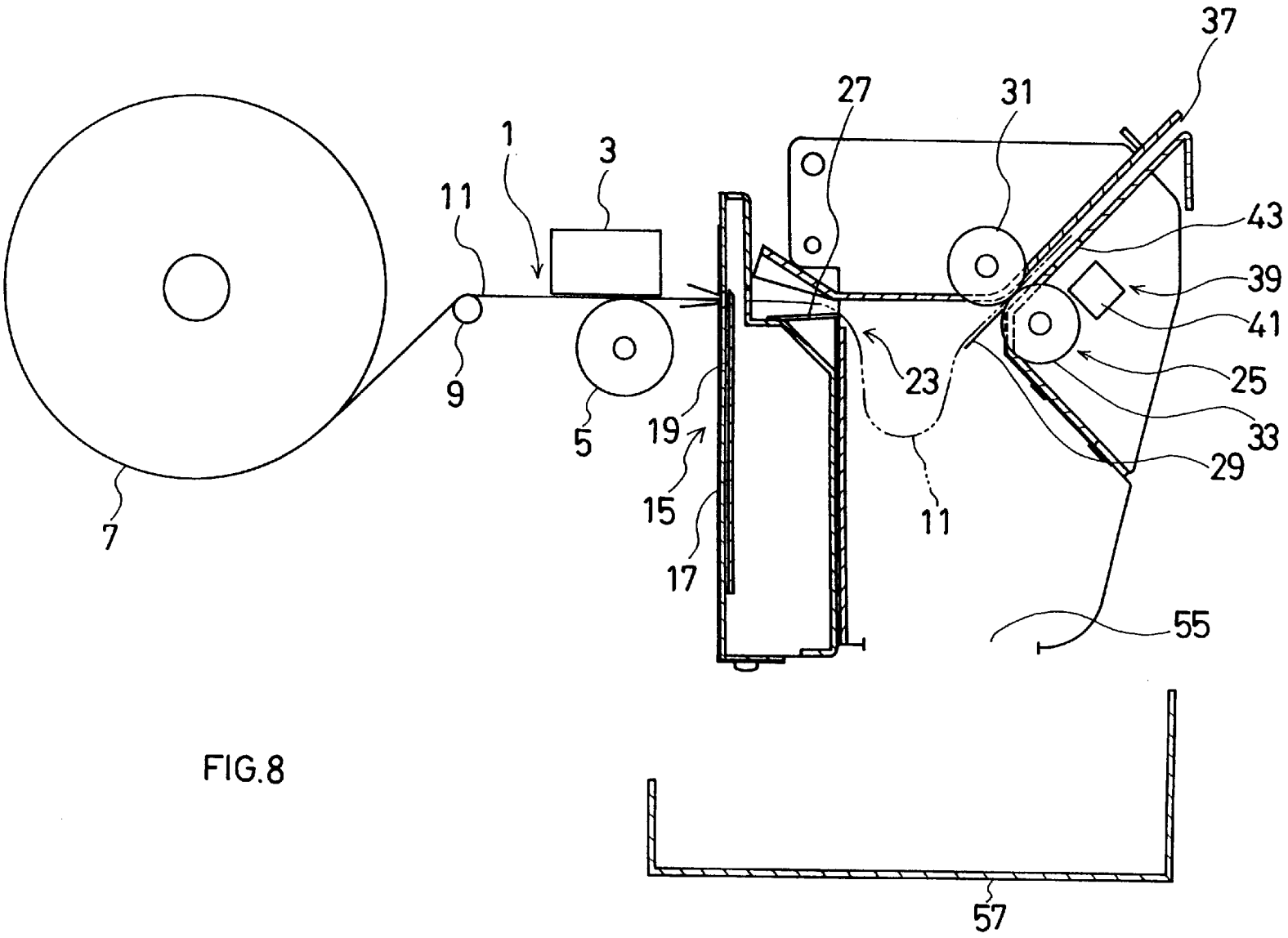
FIG. 8 is a view showing an operation of the paper discharging apparatus according to the first embodiment of the present invention.
Figure 9:
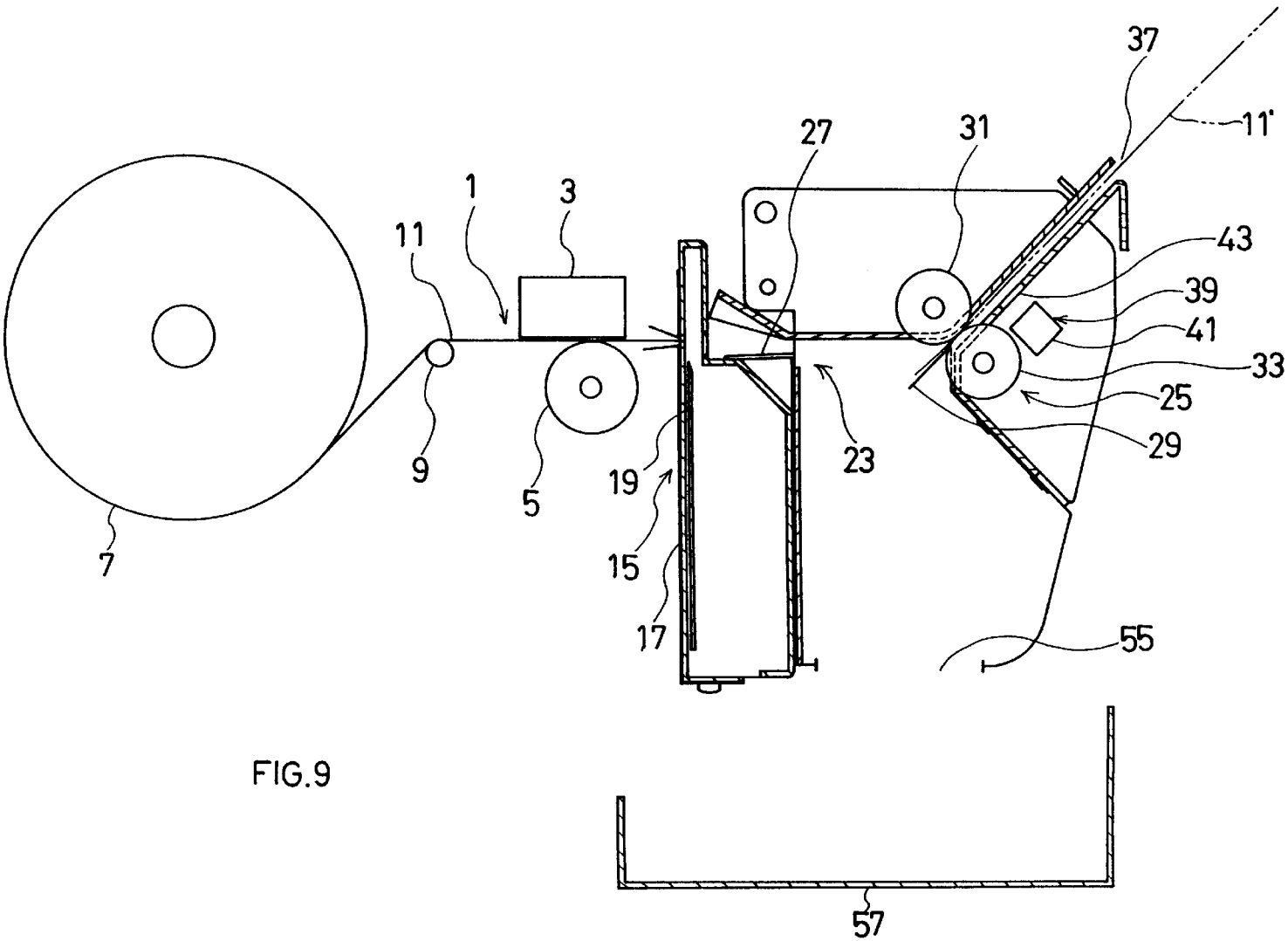
FIG. 9 is a view showing an operation of the paper discharging apparatus according to the first embodiment of the present invention.

Even after the halt of the discharge operation as above described, although the top of the paper is a standstill state held by the pair of the discharging rollers 31 and 33, the paper 11 is further fed from the side of the printing means 1, thus the paper 11 becomes sagged like a loop as illustrated in FIG. 6. When such a sagged state of paper 11 goes on, the loop-shaped sag of the paper 11 becomes larger as shown in FIG. 7. In such a state, when the printing operation is completed, the cutter 19 of the cutting means 15 cuts the paper 11 at a predetermined length as shown in FIG. 8. After that, as illustrated in FIG. 9, the discharge operation by the pair of discharging rollers 31 and 33 restarts, thus the paper 11 is discharged as the receipt 11' from the discharging outlet 37.

The above described is a series of operation in a normal state.

As the next explanation, the operation when the paper 11 becomes limp and the top of the paper 11 does not normally insert between the pair of discharging rollers 31 and 33, will now be described with reference to FIGS. 10 and 11.

Figure 10:
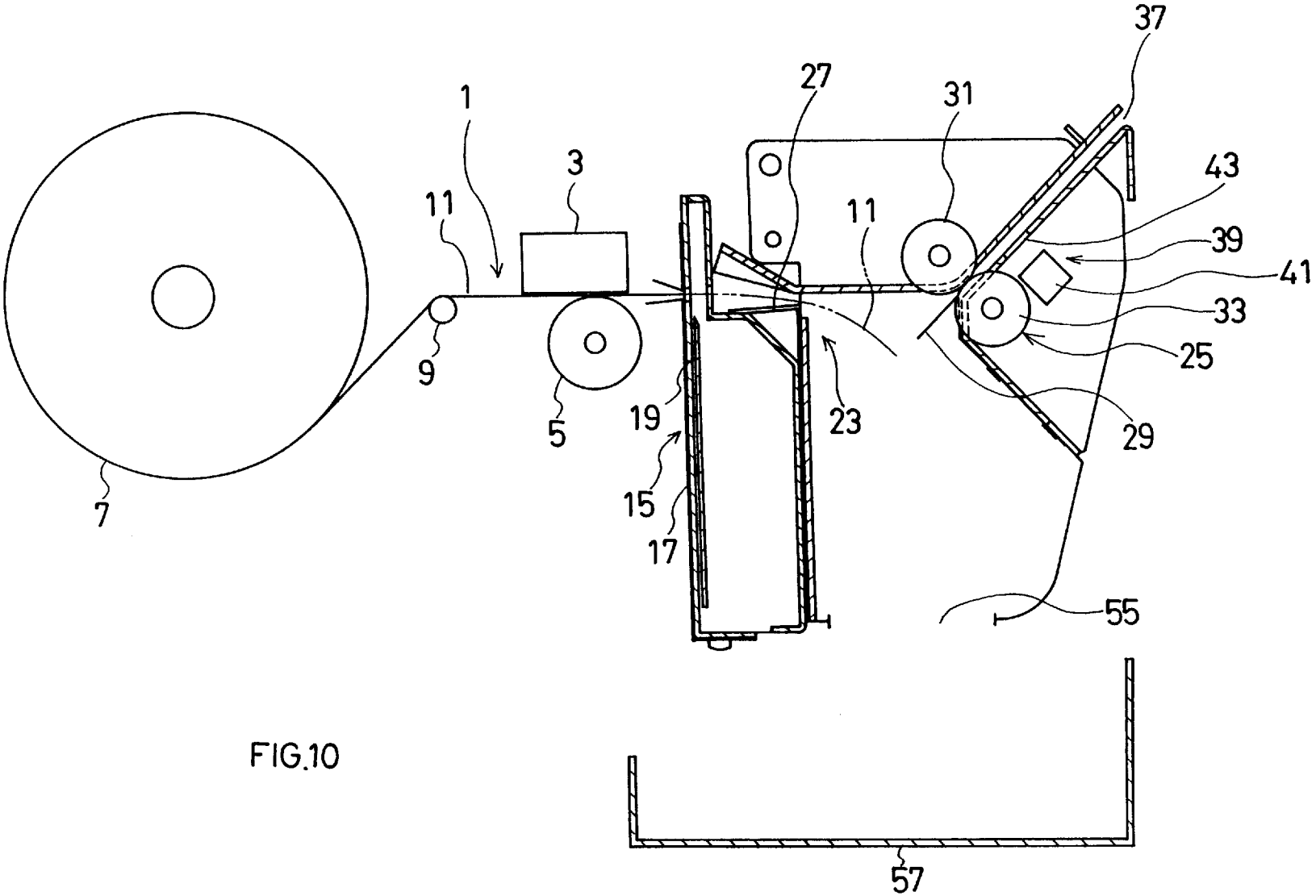
FIG. 10 is a view showing an operation of the paper discharging apparatus according to the first embodiment of the present invention.
Figure 11:
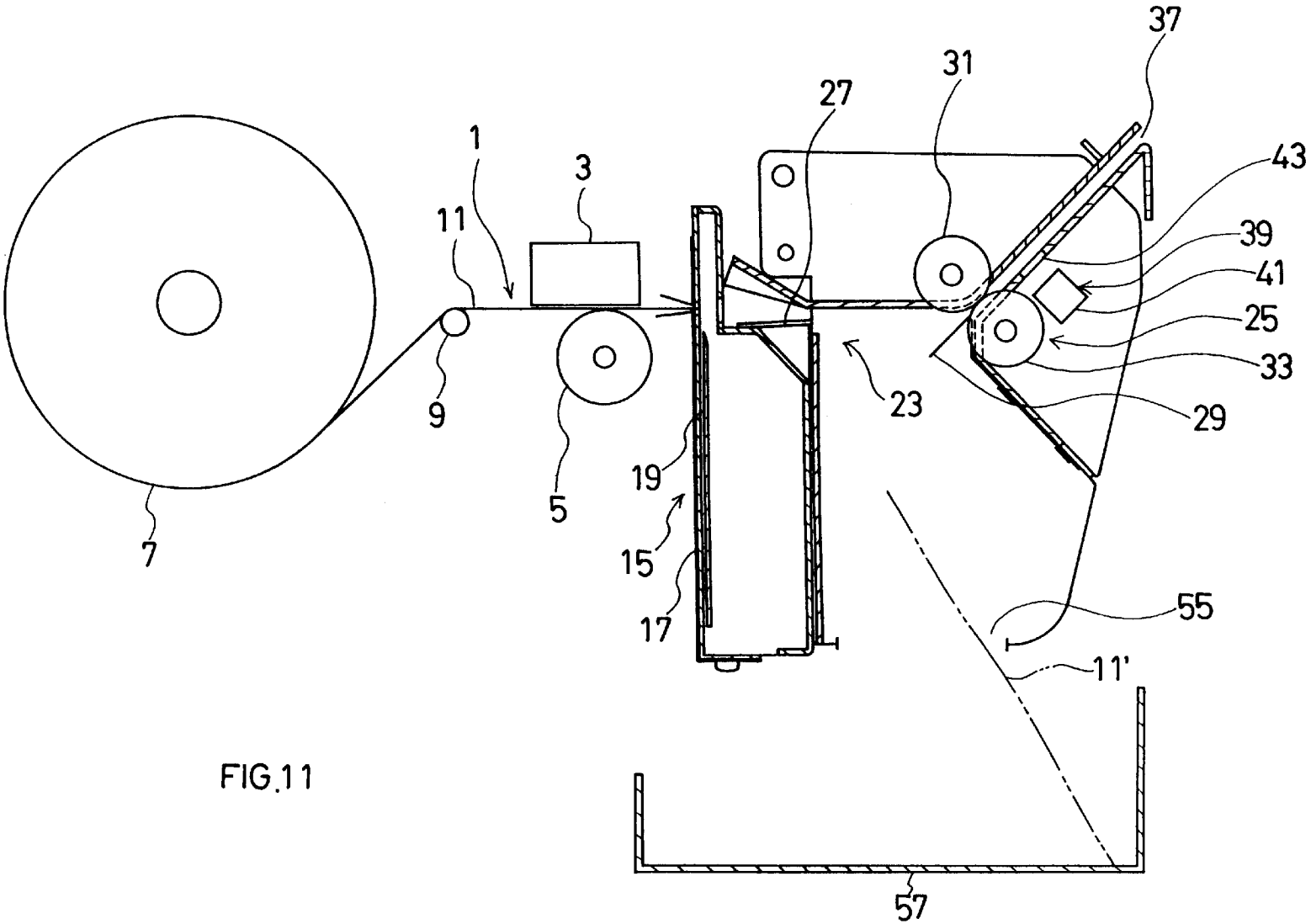
FIG. 11 is a view showing an operation of the paper discharging apparatus according to the first embodiment of the present invention.

In this case, as illustrated in FIG. 10, the top of the paper 11 droopingly goes down during printing operation, thus the normal spanning with the paper 11 toward the guide plate 29 cannot be carried out. Therefore the receipt 11' after the predetermined printing is cut by the cutting means 15, then collected in the collection tray 57 via the opening 55, which is illustrated in FIG. 11.

The next operation will be described with reference to FIGS. 12 through 20, in the case the paper 11 becomes limp and creases, thus the jamming of paper occurs as the paper does not insert between the pair of the discharging rollers 31 and 33.

Figure 12:
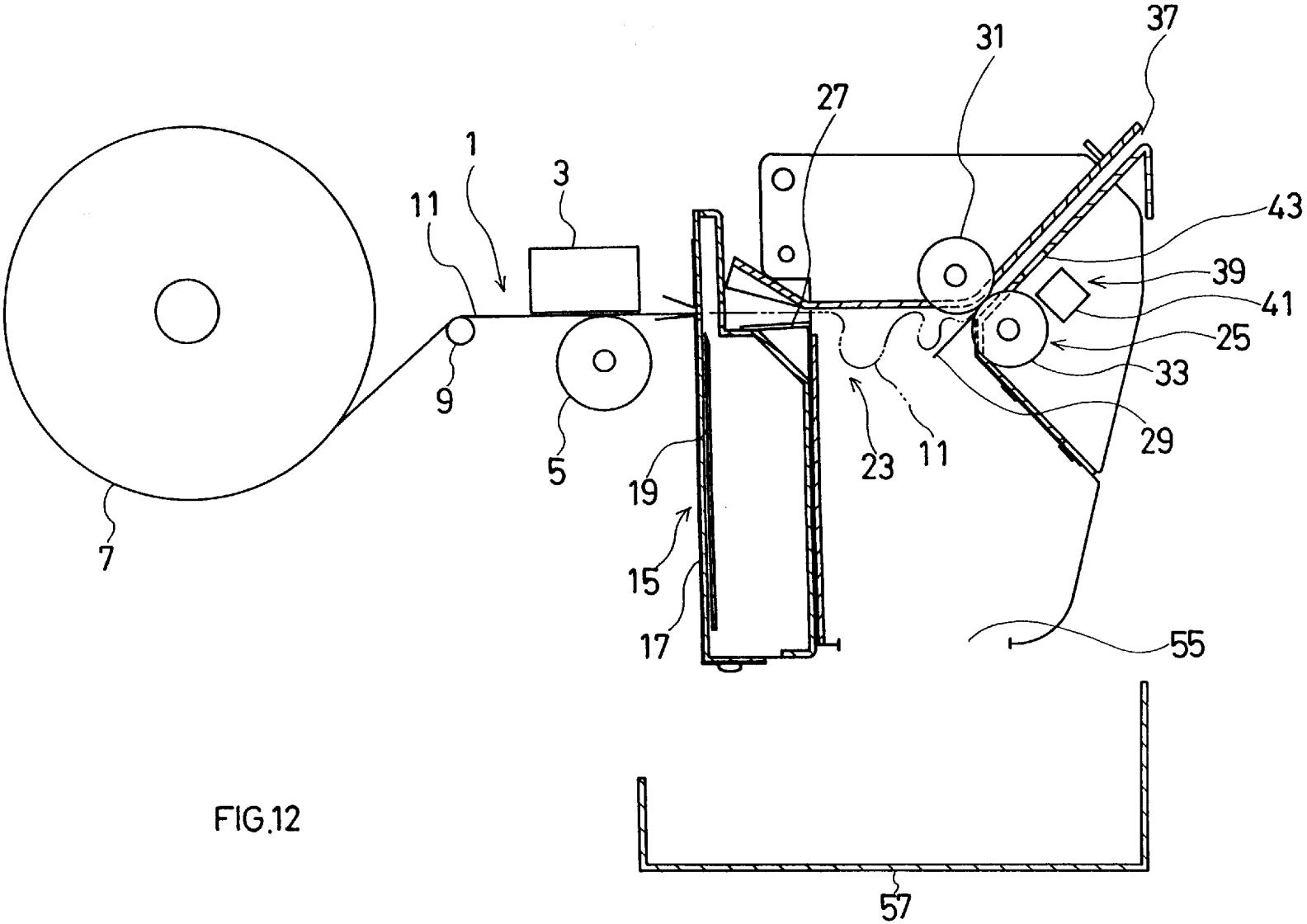
FIG. 12 is a view showing an operation of the paper discharging apparatus according to the first embodiment of the present invention.
Figure 13:
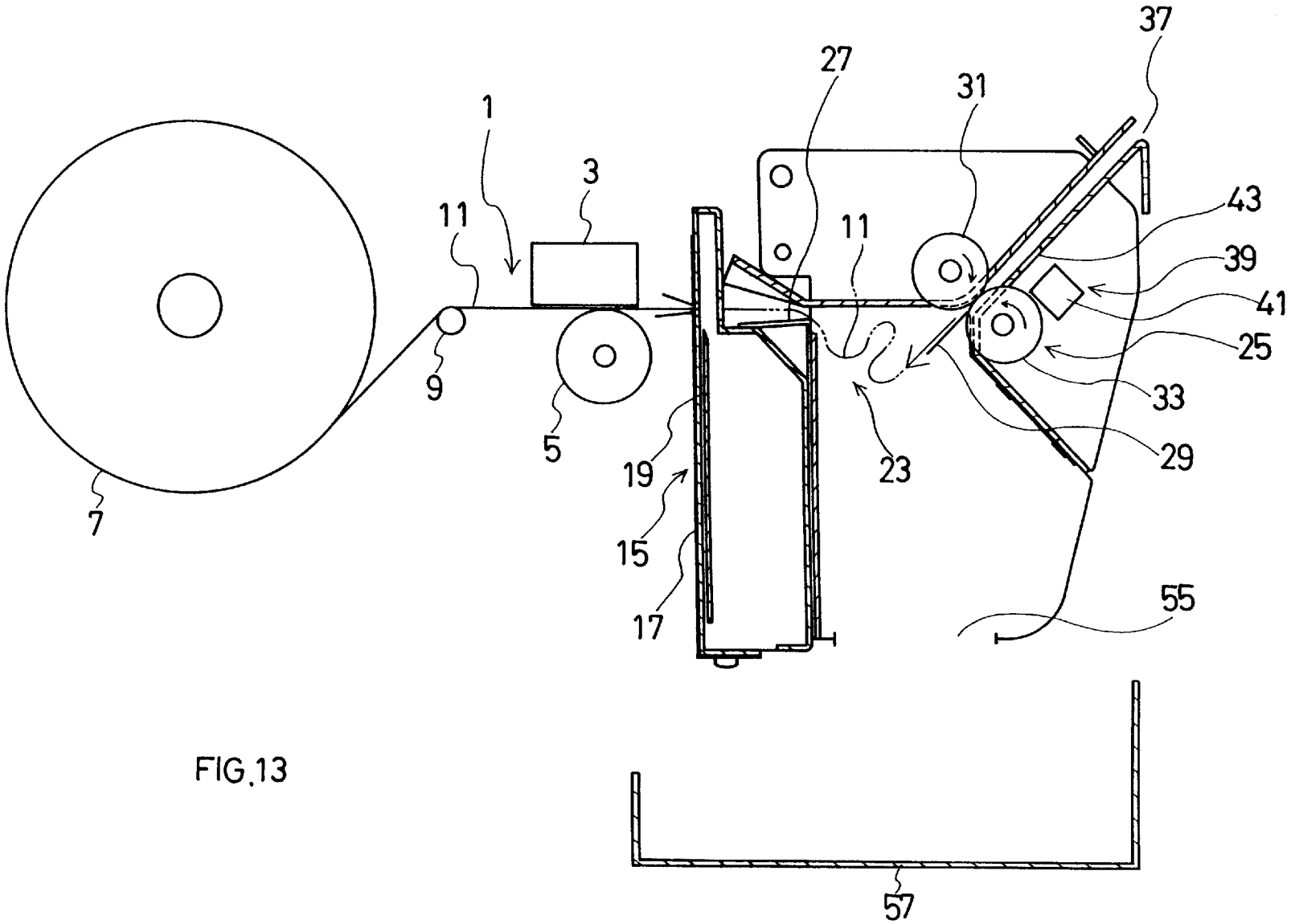
FIG. 13 is a view showing an operation of the paper discharging apparatus according to the first embodiment of the present invention.

In this case, as shown in FIG. 12, the paper 11 becomes limp and there is the crease on the paper 11. Accordingly, the top of the paper 11 does not normally insert between the pair of discharging rollers 31 and 33, thus the jamming of paper occurs. The paper sensor 41 cannot detect the top of the paper 11 in such a state, and the pair of discharging rollers 31 and 33 rotate in the reverse directions as shown in FIG. 13 (namely, not the normal discharging directions) in order to return the paper 11 toward the opposite direction of the discharging outlet 37. The thus obtained state is as illustrated in FIG. 14.

Figure 14:
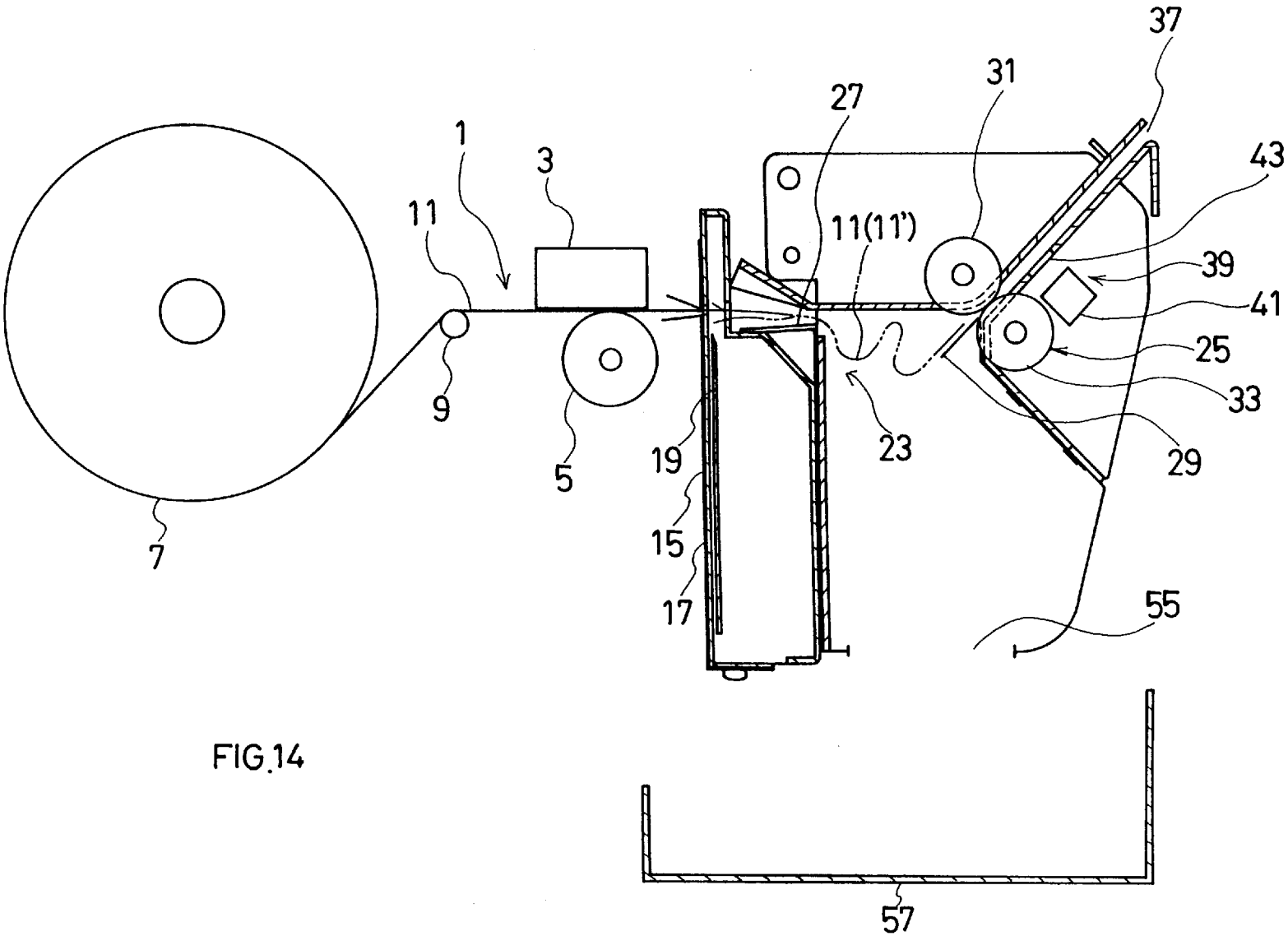
FIG. 14 is a view showing an operation of the paper discharging apparatus according to the first embodiment of the present invention.
Figure 15:
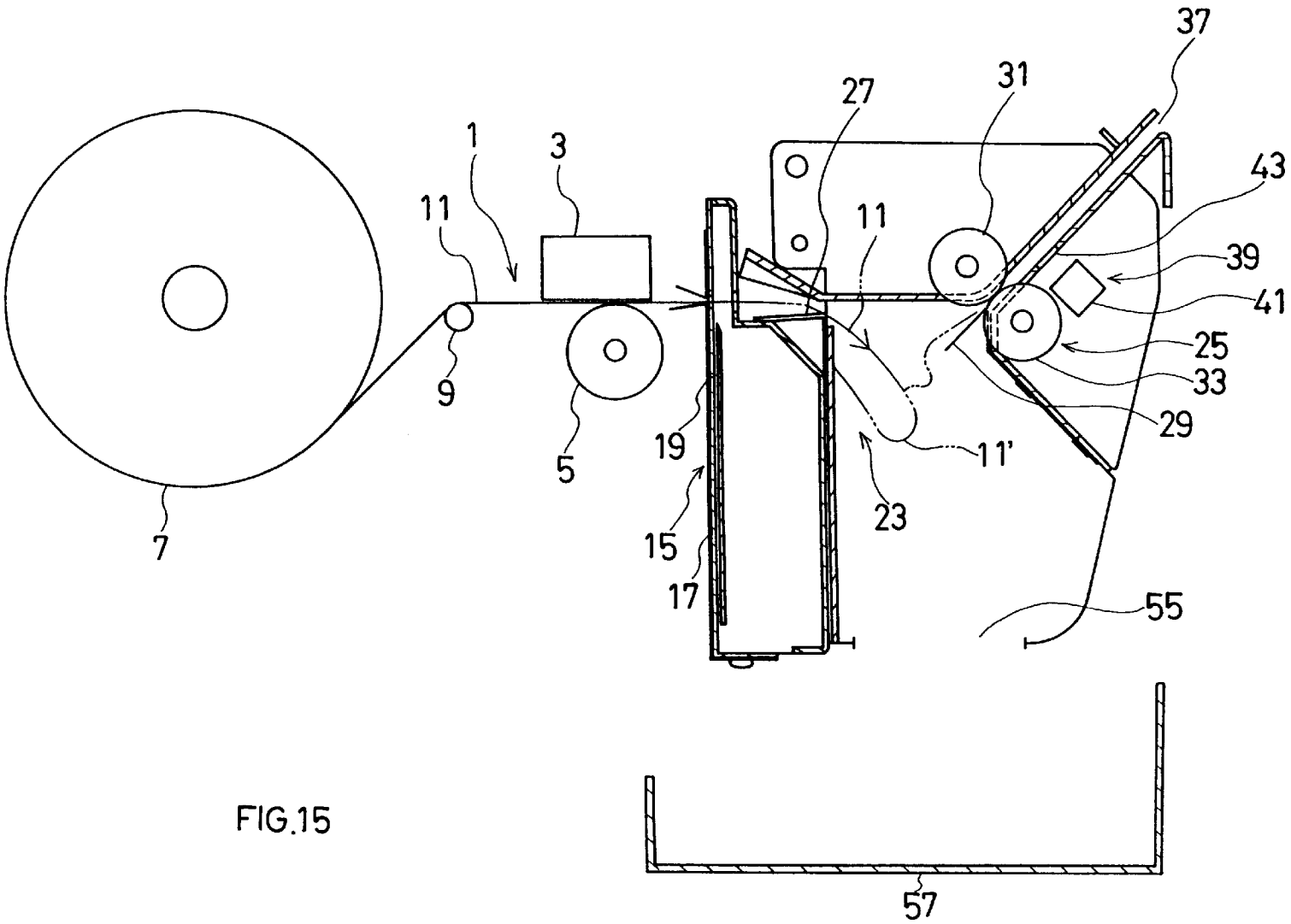
FIG. 15 is a view showing an operation of the paper discharging apparatus according to the first embodiment of the present invention.

In the state as shown in FIG. 14, with regard to the paper 11, the printing has been carried out by the printing means 1 thereon, as well as the cutting at a predetermined length by the cutting means 15 has also been made. The paper 11 therefore becomes the receipt 11'.

Figure 16:
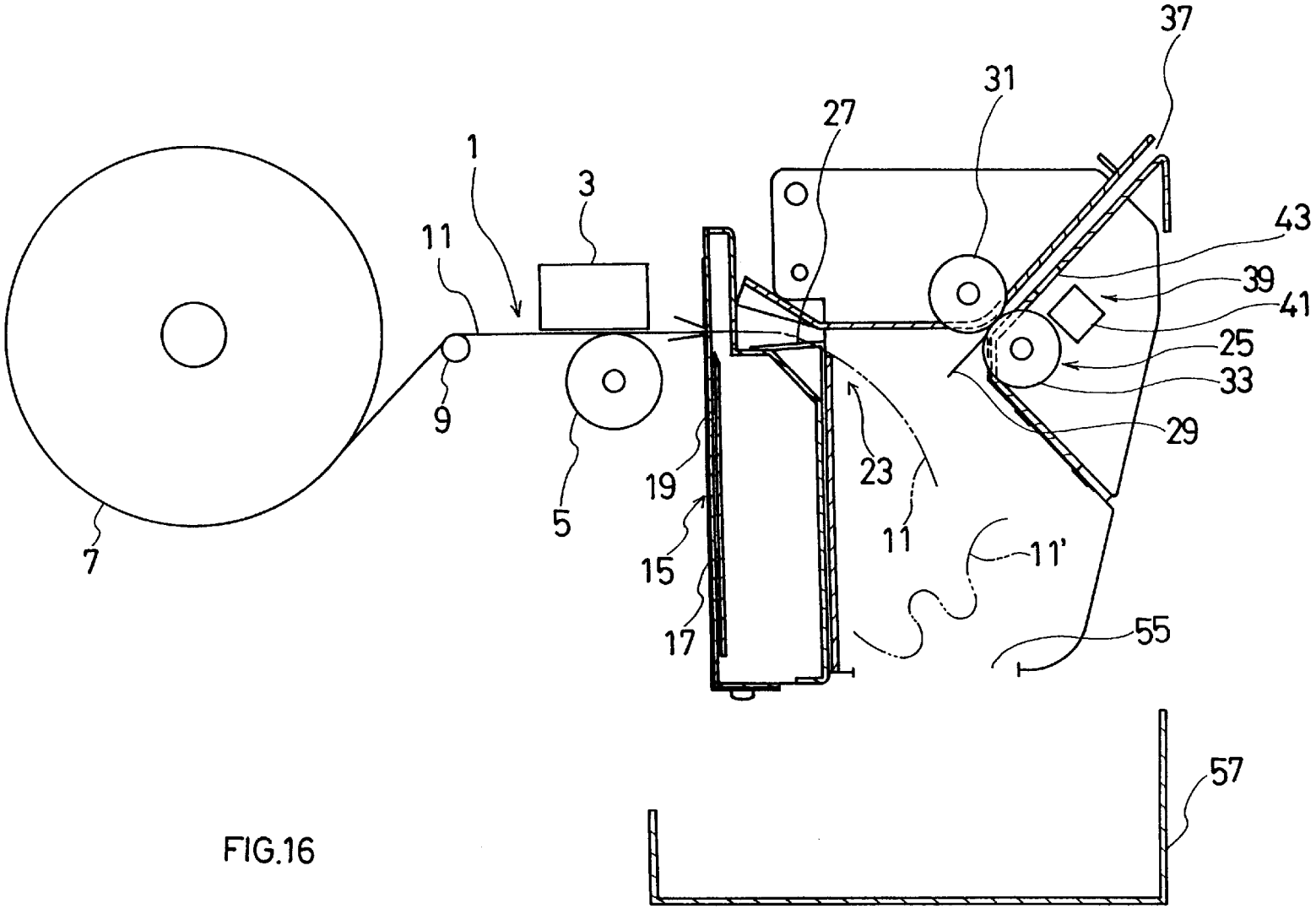
FIG. 16 is a view showing an operation of the paper discharging apparatus according to the first embodiment of the present invention.
Figure 17:
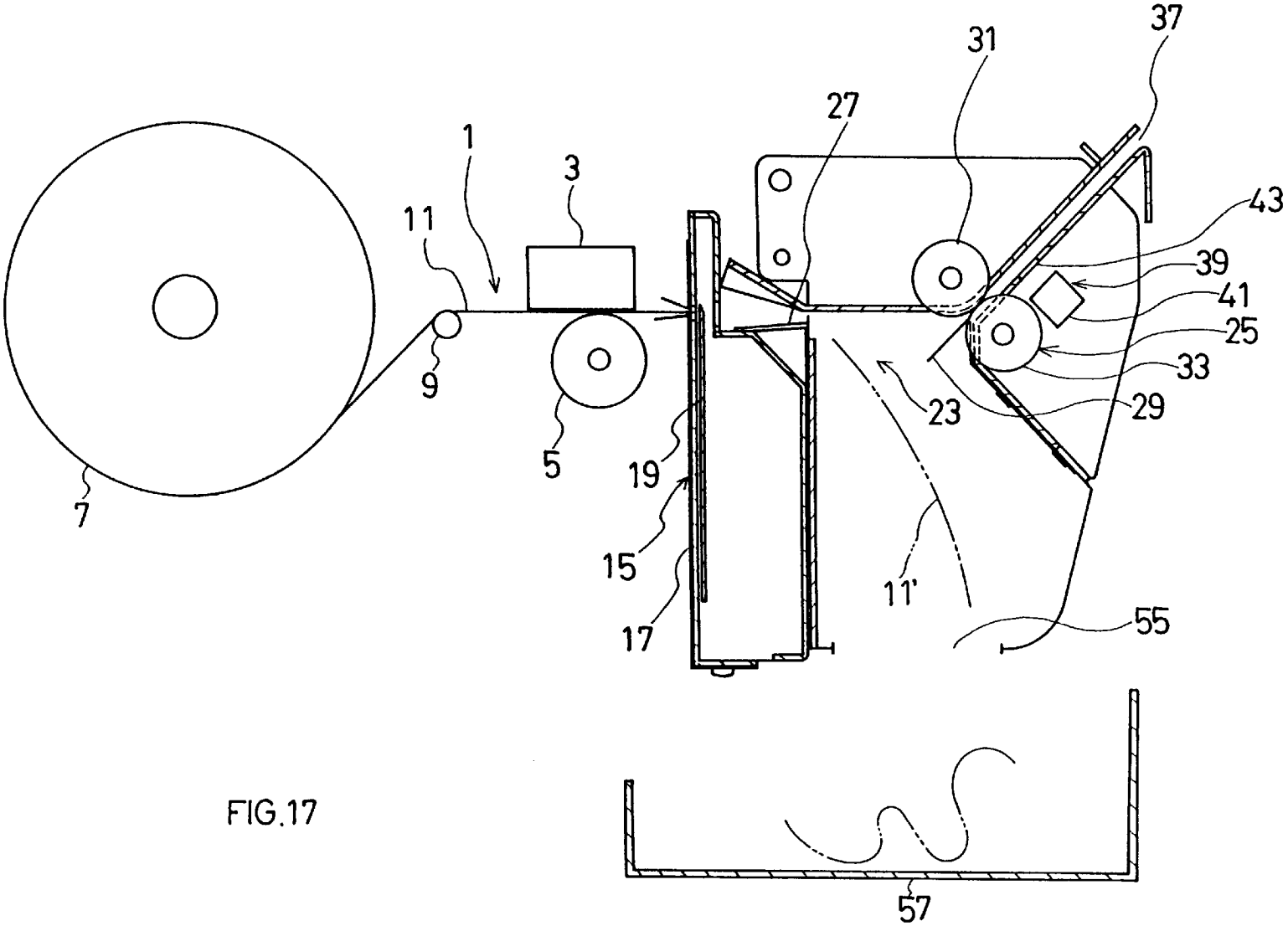
FIG. 17 is a view showing an operation of the paper discharging apparatus according to the first embodiment of the present invention.

After that, the retry operation (reissue operation) is carried out by using the next paper 11 fed from the paper roll 7. Namely, since the foregoing printed paper 11 has not normally been discharged as the receipt 11', such a foregoing paper is returned and the same operation is carried out again by using the next paper. As a result, the foregoing receipt 11' which has been returned and remained between the guide plates 27 and 29, is pushed toward the opening 55 by the top of the next paper 11 conveyed by the retry operation. Thus the foregoing printed receipt 11' is collected in the collection tray 57 via the opening 55, as illustrated in FIGS. 16 and 17. In addition, the next paper 11 conveyed by the retry operation is also collected, as another undischarged receipt 11', in the collection tray 57 via the opening 55.

There may be a case that the reissued paper 11 is normally discharged as the receipt 11'. In this case, the paper 11 is not collected in the collection tray 57 but discharged via the discharging outlet 37, which will be described below in detail.

Figure 18:
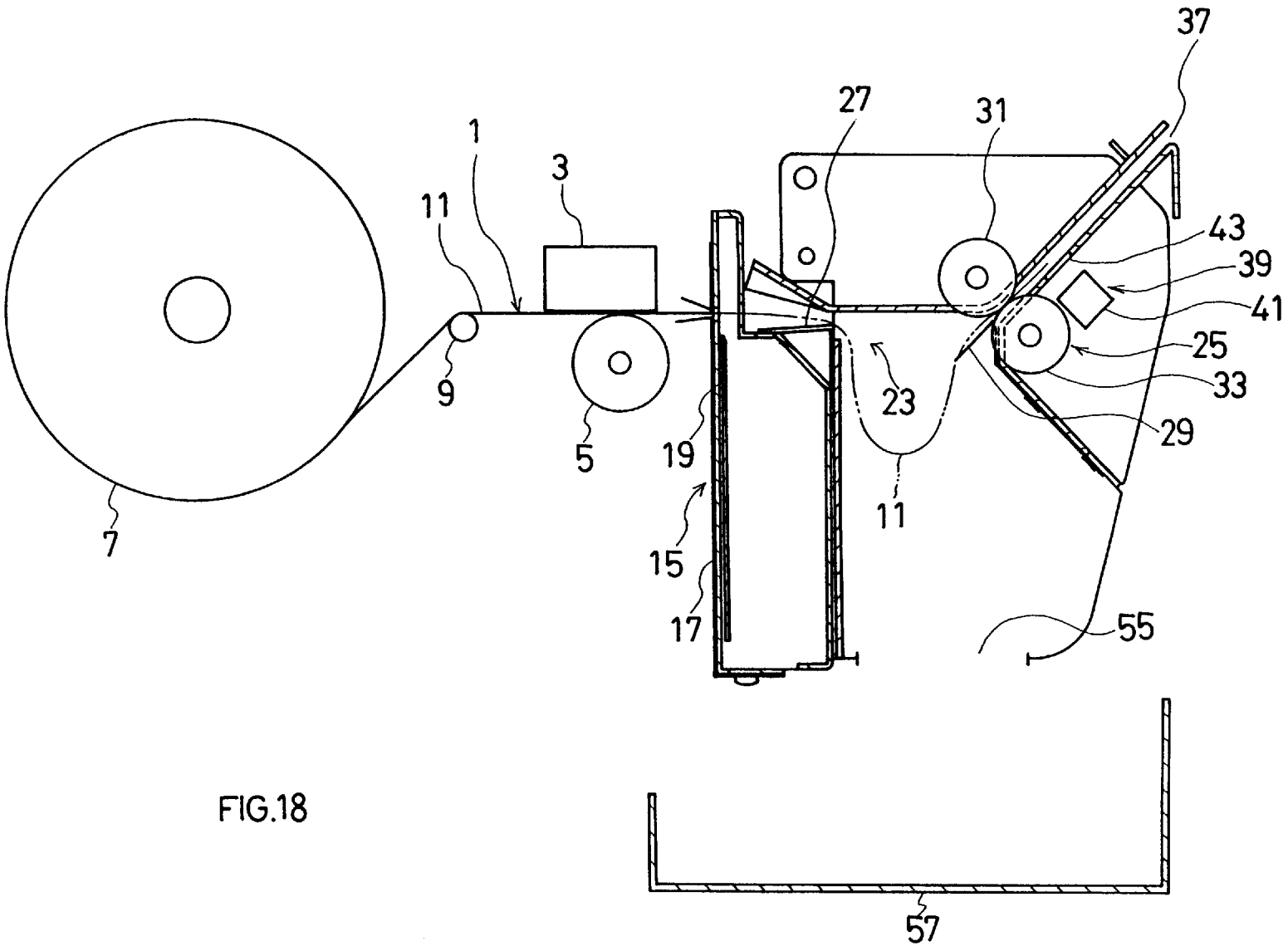
FIG. 18 is a view showing an operation of the paper discharging apparatus according to the first embodiment of the present invention.
Figure 19:
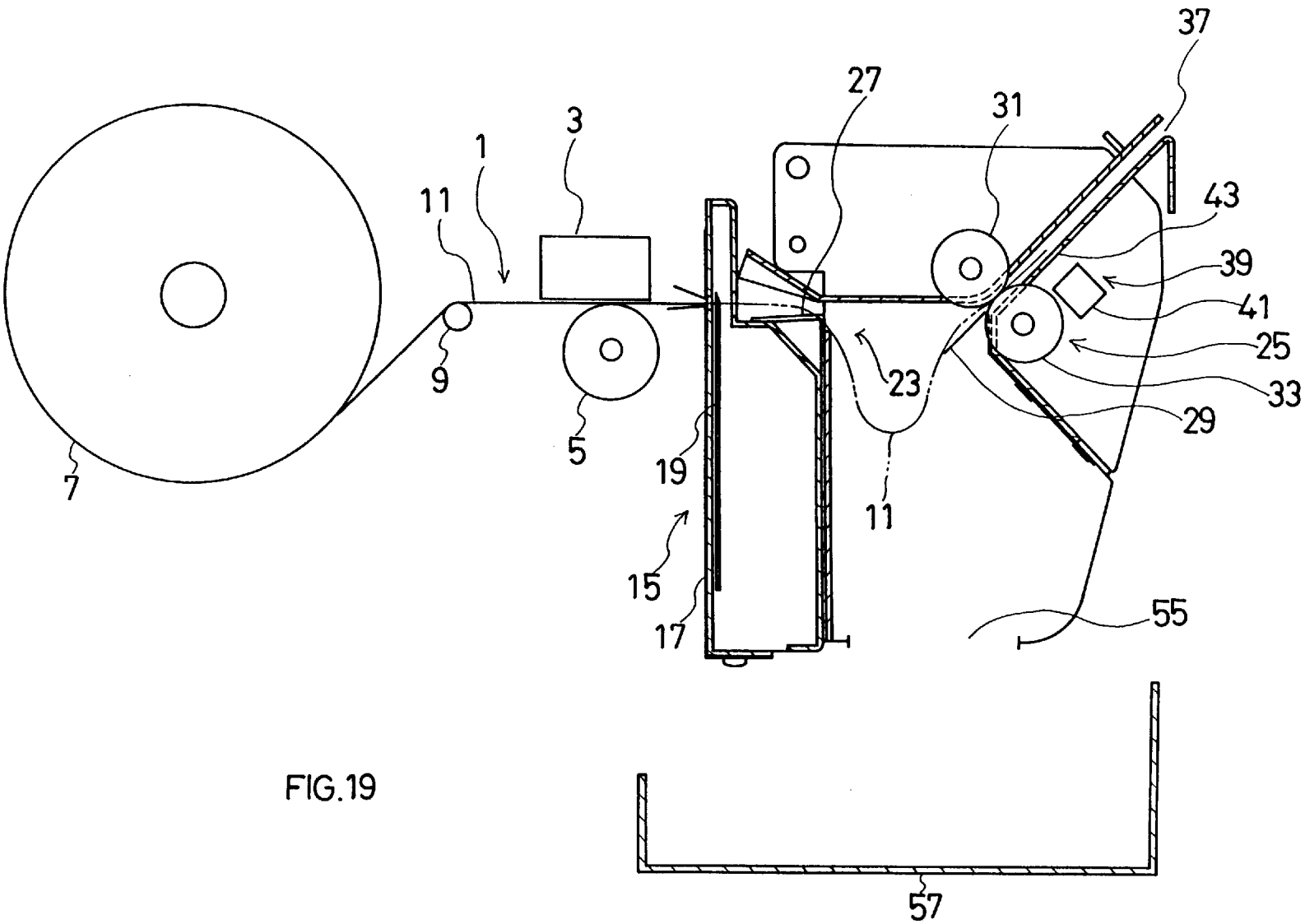
FIG. 19 is a view showing an operation of the paper discharging apparatus according to the first embodiment of the present invention.
Figure 20:
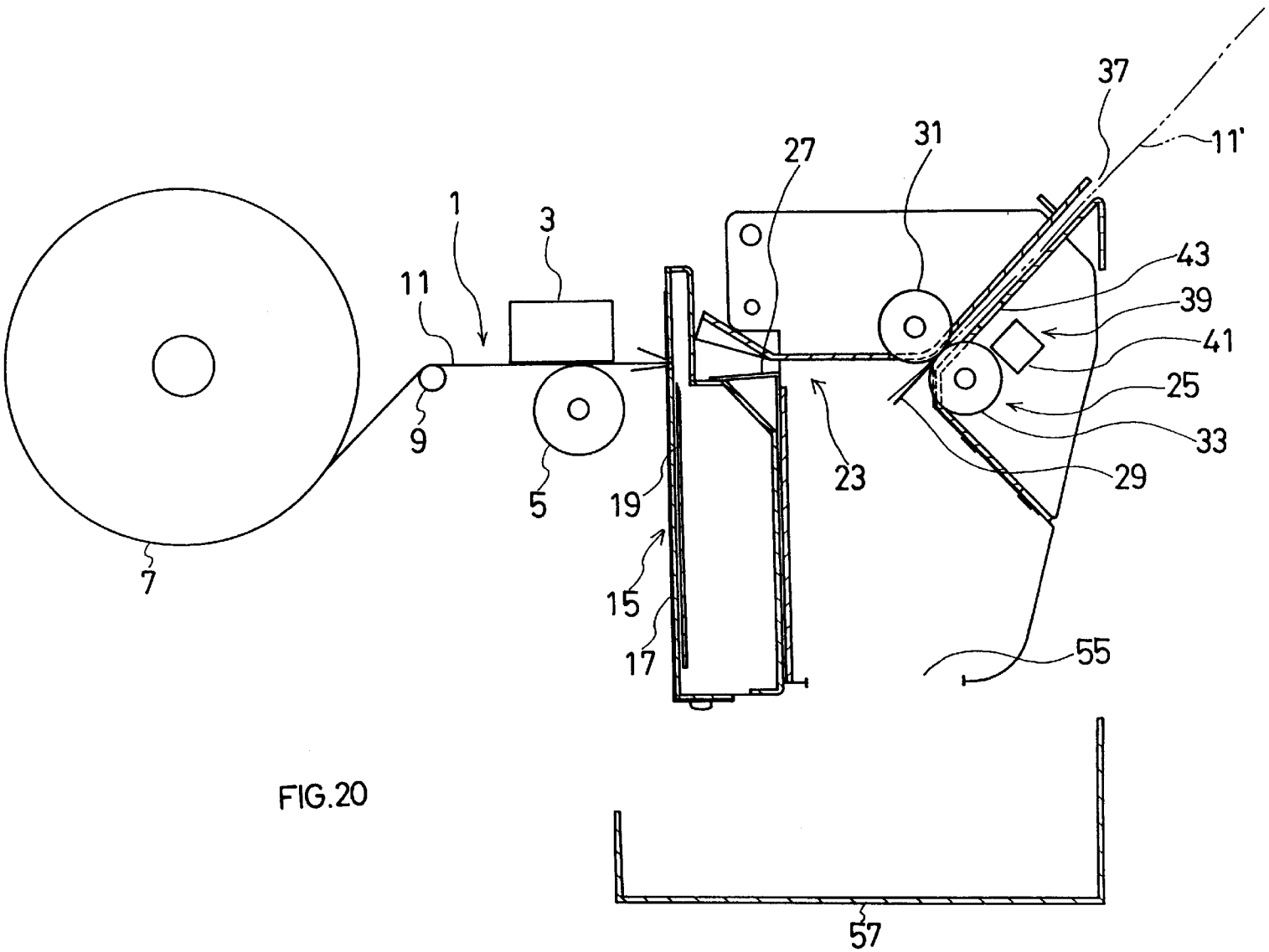
FIG. 20 is a view showing an operation of the paper discharging apparatus according to the first embodiment of the present invention.

As illustrated in FIG. 18, the receipt issue operation is carried out again. Since the foregoing printed receipt 11' does not exist, the receipt 11' is normally discharged in the operation as shown in FIGS. 19 and 20.

Figure 21:
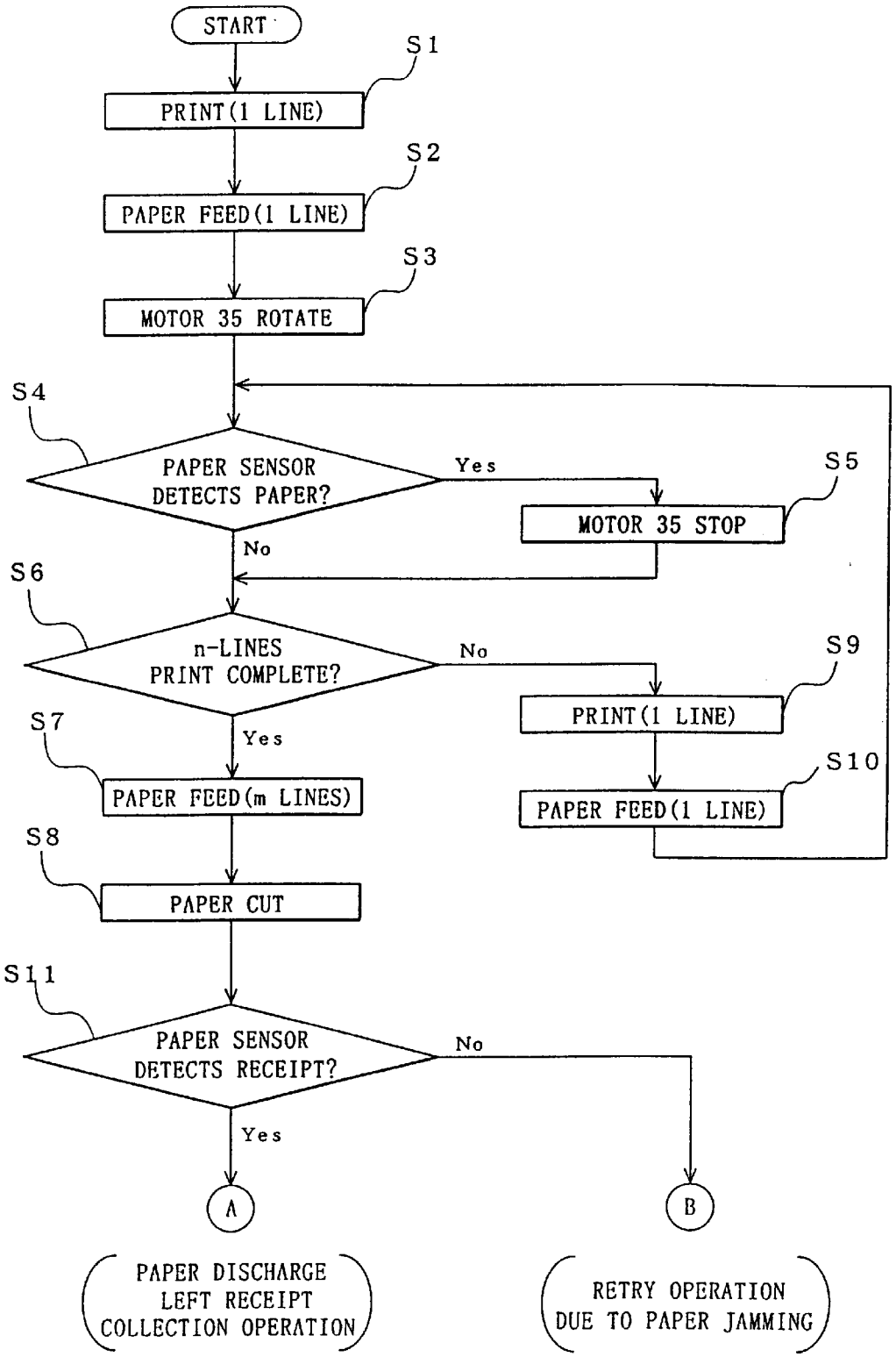
FIG. 21 is a flowchart showing an operation of the paper discharging apparatus according to the first embodiment of the present invention.
Figure 22:
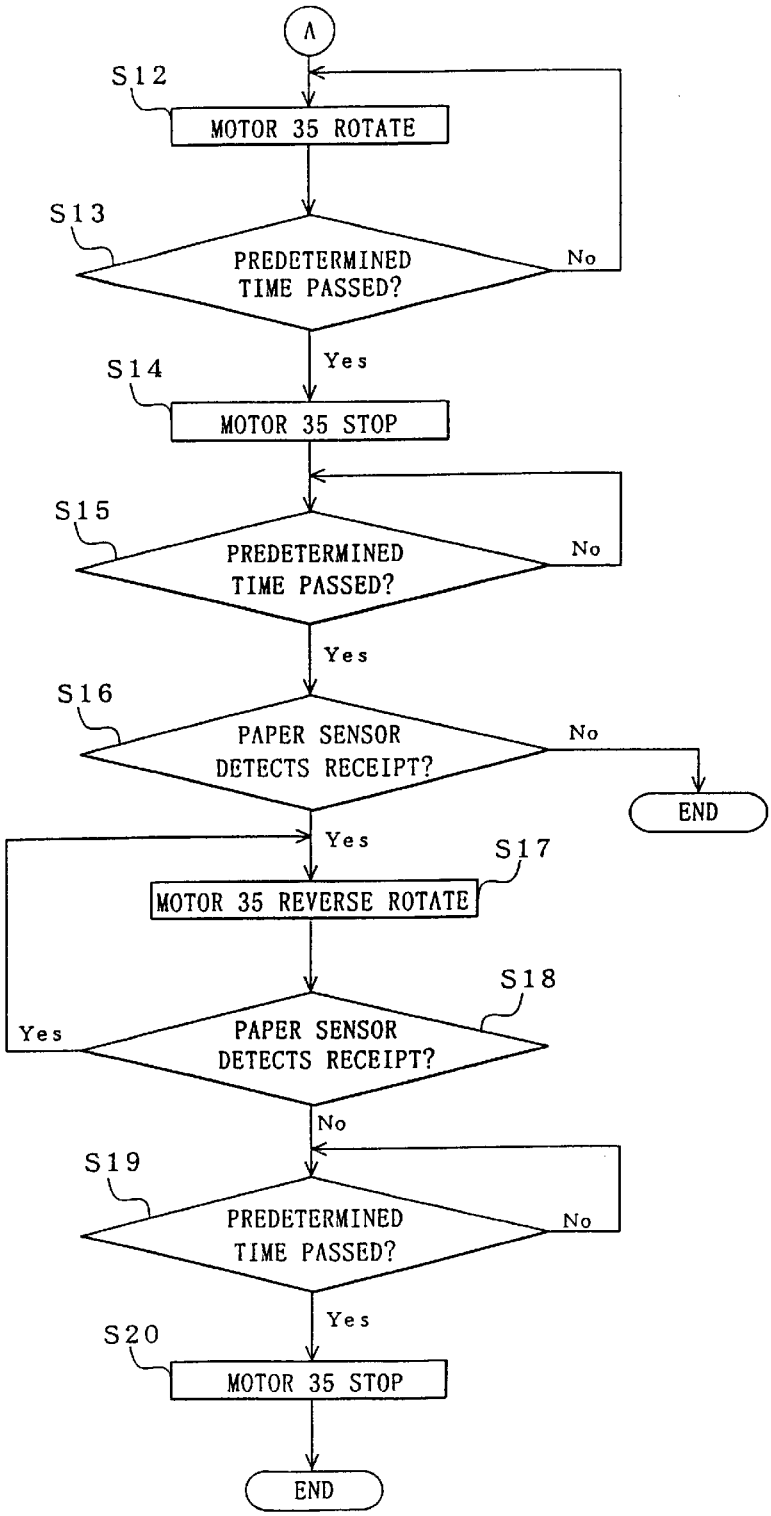
FIG. 22 is a flowchart showing an operation of the paper discharging apparatus according to the first embodiment of the present invention.
Figure 23:
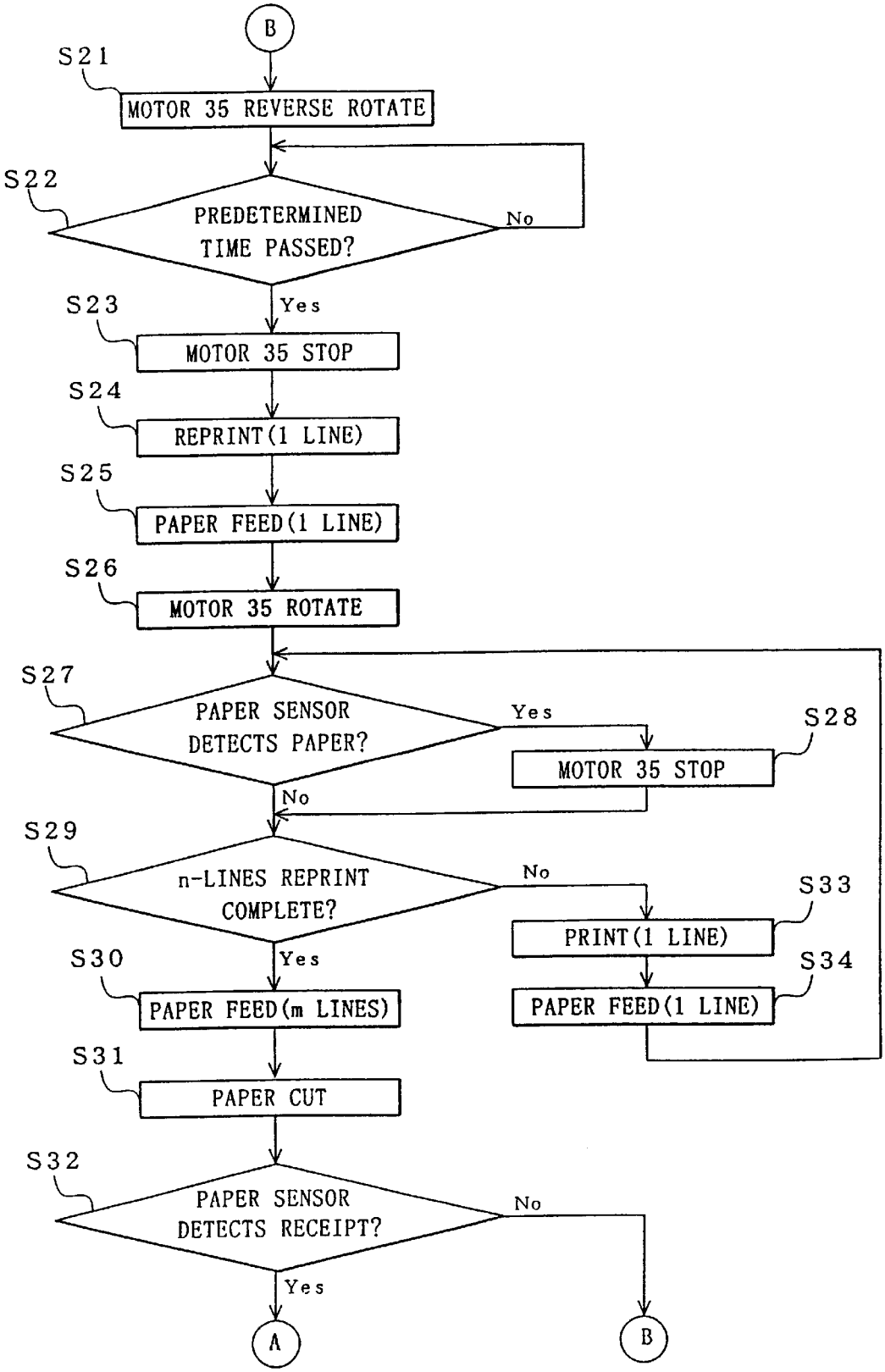
FIG. 23 is a flowchart showing an operation of the paper discharging apparatus according to the first embodiment of the present invention.

The above described operations will now be put in order with reference to flowcharts as shown in FIGS. 21 through 23.

Firstly, the printing operation is carried out as shown in FIG. 21. When the printing in one line is finished (step S1), the paper is fed by the amount of one line (step S2). At the same time, the driving motor 35 rotates in order to rotatively drive the discharging roller 31 (step S3). Then control proceeds to step S4 to decide whether or not the paper sensor 41 detects the top of the paper 11. When the top of the paper 11 is detected by the paper sensor 41, control proceeds to step S5 to stop the driving motor 35. Therefore the driving motor 35 continues rotating until the top of the paper 11 is detected by the paper sensor 41.

Then control proceeds to step S6 to decide whether or not the printing in "n" lines (namely the predetermined printing as shown in FIG. 2) has been completed. When the printing has been completed, control proceeds to step S7 to execute the paper feed by "m" lines (see FIG. 2). Then control proceeds to step S8 at which the paper 11 is cut at the predetermined length by the cutting means 15 into the receipt 11'. To the contrary, if the printing in n lines has not been completed at step S6, control proceeds to step S9 to print in one line, then the paper feed by one line is carried out at step S10, and control returns to step S4. The operations of steps S9, S10, S4, (S5) and S6 are repeated until the predetermined n lines of printing is completed.

Then control proceeds to step S11 to decide whether or not the paper sensor 41 detects the top of the receipt 11'. When the paper sensor 41 detects the top of the receipt 11', further operation as shown in the flowchart of FIG. 22 is executed. To the contrary, if the paper sensor 41 does not detect the top of the receipt 11', the operation as shown in the flowchart of FIG. 23 is executed.

Firstly, in the case that the paper sensor 41 detects the top of the receipt 11', as shown in FIG. 22, the driving motor 35 rotates (step S12), and whether or not a predetermined time passed is decided (step S13). When the predetermined time of step S13 passed, control proceeds to step S14 to stop the driving motor 35. To the contrary, if the predetermined time of step S13 has not passed, control returns to step S12 to repeatedly execute the operations of steps S13 and S12. When the driving motor 35 stops, control proceeds to step S15 to decide whether or not a predetermined time passed. When the predetermined time of step S15 passed, then control proceeds to step S16 to decide whether or not the paper sensor 41 detects the receipt 11'. To the contrary, when the predetermined time of step S15 has not passed, the decision at step S15 is repeatedly executed.

When the paper sensor 41 detects the receipt 11' at step S16, control proceeds to step S17 to rotate the driving motor 35 in the reverse direction. When the driving motor 35 rotates in the reverse direction, the receipt 11' not normally discharged is fed in the opposite direction to return to the space between the guide plates 27 and 29. To the contrary, when the paper sensor 41 does not detect the receipt 11' at step S16, the normal paper discharge is considered to have been completed, and the operation ends. Namely, as long as the receipt 11' has normally been discharged, the receipt 11' cannot be detected by the paper sensor 41 at step S16, and if the receipt 11' is detected by the paper sensor 41 at step S16, the receipt 11' is considered not to be discharged in a normal state.

After the reverse rotation of the driving motor 35 at step S17, control proceeds to step S18 to decide whether or not the receipt 11' is detected again by the paper sensor 41. If the receipt 11' is still detected by the paper sensor 41, the driving motor 35 continues rotating in the reverse direction, since in this case the receipt 11' has not been returned to the space between the guide plates 27 and 29. Thus the receipt 11' is conveyed by continuing the reverse rotation of the driving motor 35 to return to such a space. When the receipt 11' is not detected at step S18, control proceeds to step S19 to decide whether or not a predetermined time passed. When the predetermined time of step S19 passed, control proceeds to step S20 to stop the driving motor 35. When the predetermined time of step S19 has not passed, the decision at step S19 is repeatedly executed until such a time passed. If the time passed, the receipt 11' is considered to be returned to the space between the guide plates 27 and 29.

Secondly, in the case that the paper sensor 41 does not detect the top of the receipt 11' at step S11 shown in the flowchart of FIG. 21, will now be described with reference to the flowchart of FIG. 23. In this case, the driving motor 35 rotates in the reverse direction (step S21). Then control proceeds to step S22 to decide whether or not a predetermined time passed. If the predetermined time of step S22 has not passed, the decision is repeatedly executed until the time passed. When the predetermined time of step S22 passed, control proceeds to step S23 to stop the driving motor 35. The reprinting in one line is carried out on the paper 11 (step S24), then the paper feed by one line is also carried out (step S25), and the driving motor 35 rotates (step S26)

After that, control proceeds to step S27 to decide whether or not the paper sensor 41 detects the paper 11. When the paper 11 is detected, the driving motor 35 stops (step S28) When not detected, control proceeds to step S29 to decide whether or not the reprinting in n lines has been completed. If the reprinting in n lines has been completed, control proceeds to step S30 to feed the paper by m lines, then the paper 11 is cut at step S31 into the receipt 11' which is the same as the foregoing not-discharged one. Then control proceeds to step S32 to decide whether or not the paper sensor 41 detects the receipt 11'. When the receipt 11' is detected, control proceeds to the operation as shown in FIG. 22. If not detected, control repeats the operation of FIG. 23.

In addition, when the reprinting in n lines has not been completed at step S29, the printing in one line is carried out at step S33, the paper feed by one line is carried out at step S34, and control returns to step S27. Accordingly, the operations of steps S33, S34, S27, (S28) and S29 are repeated until the reprinting in n lines has been completed.

The first embodiment of the present invention as above described has the following advantageous points.

Firstly, although the jamming of paper does not occur, for example when the receipt 11' was not normally discharged because the user forgot picking up the receipt and left the receipt at the outlet, the left receipt 11' is collected in the collection tray 57. Thus the suspension of issue of receipt due to the left receipt 11' will not occur.

Secondly, when the jamming of paper occurs, the paper is returned and the retry operation is executed. Thus the jammed receipt 11' is collected in the collection tray 57, and at the same time, the receipt 11' is reissued in a normal state. Therefore the suspension of issue of receipt due to the jamming of paper will not occur.

Especially, since the present embodiment has a function that the receipt 11', which is once returned, is pressed down toward the opening 55 by the top of the reissued paper 11, the returned receipt 11' is sure to be conveyed toward the collection tray 57.

Further, although in most cases the normal discharge of the receipt 11' can be carried out by single collection and retry operation, even when the normal discharge cannot be carried out by a single operation, the present embodiment is programmed to repeat the reissue operation. Thus the receipt 11' can be discharged without fail, so that the receipt issue operation after that can normally be carried out.

Second Embodiment

A second embodiment of the present invention will now be described with reference to FIGS. 24 through 28. In the second embodiment, when the jamming of paper occurs, a dummy receipt of which length is longer than that of the ordinary receipt 11' is issued in order to collect the jammed receipt 11'.

Figure 24:
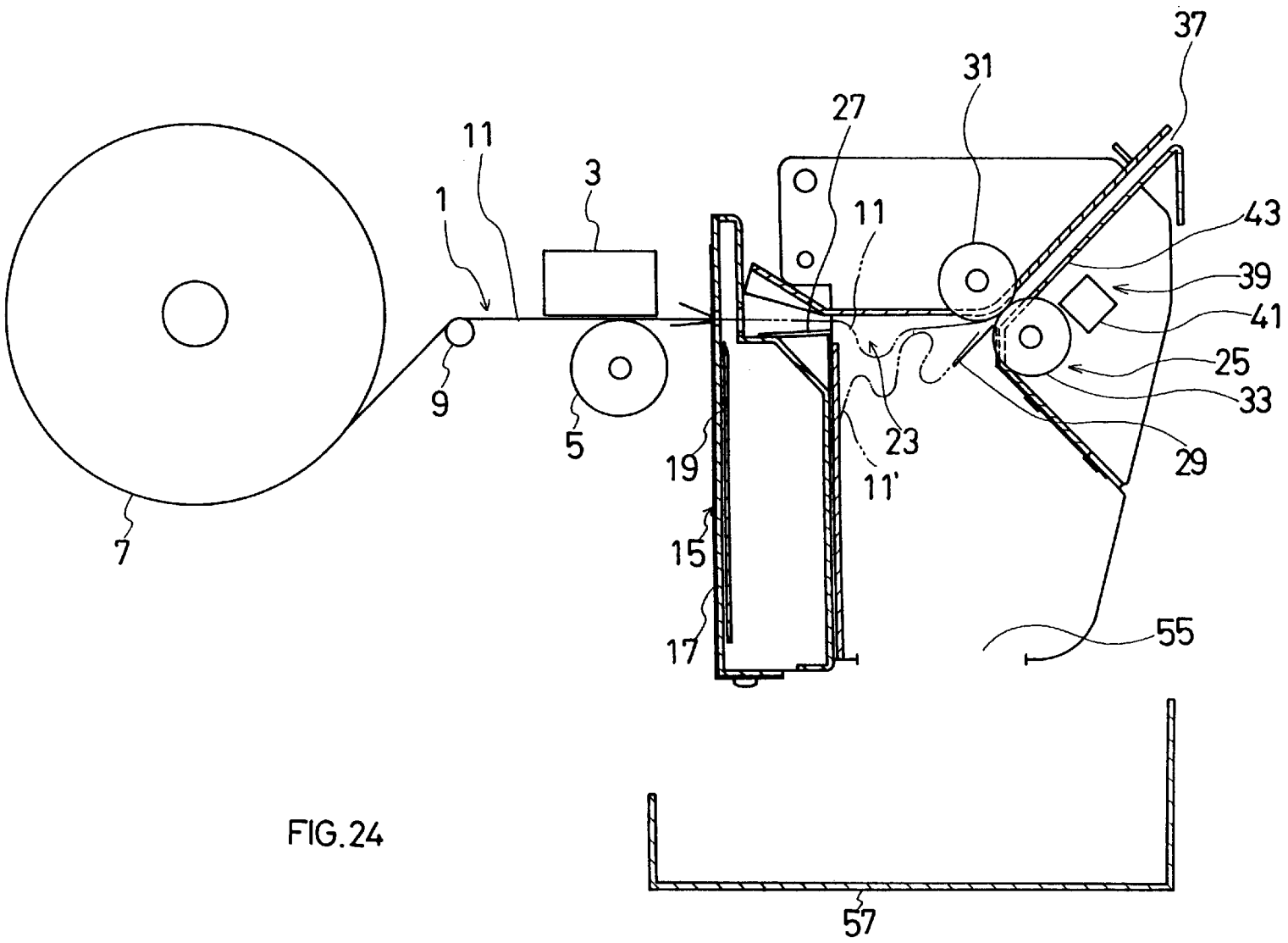
FIG. 24 is a view showing an operation of the paper discharging apparatus according to a second embodiment of the present invention.
Figure 25:
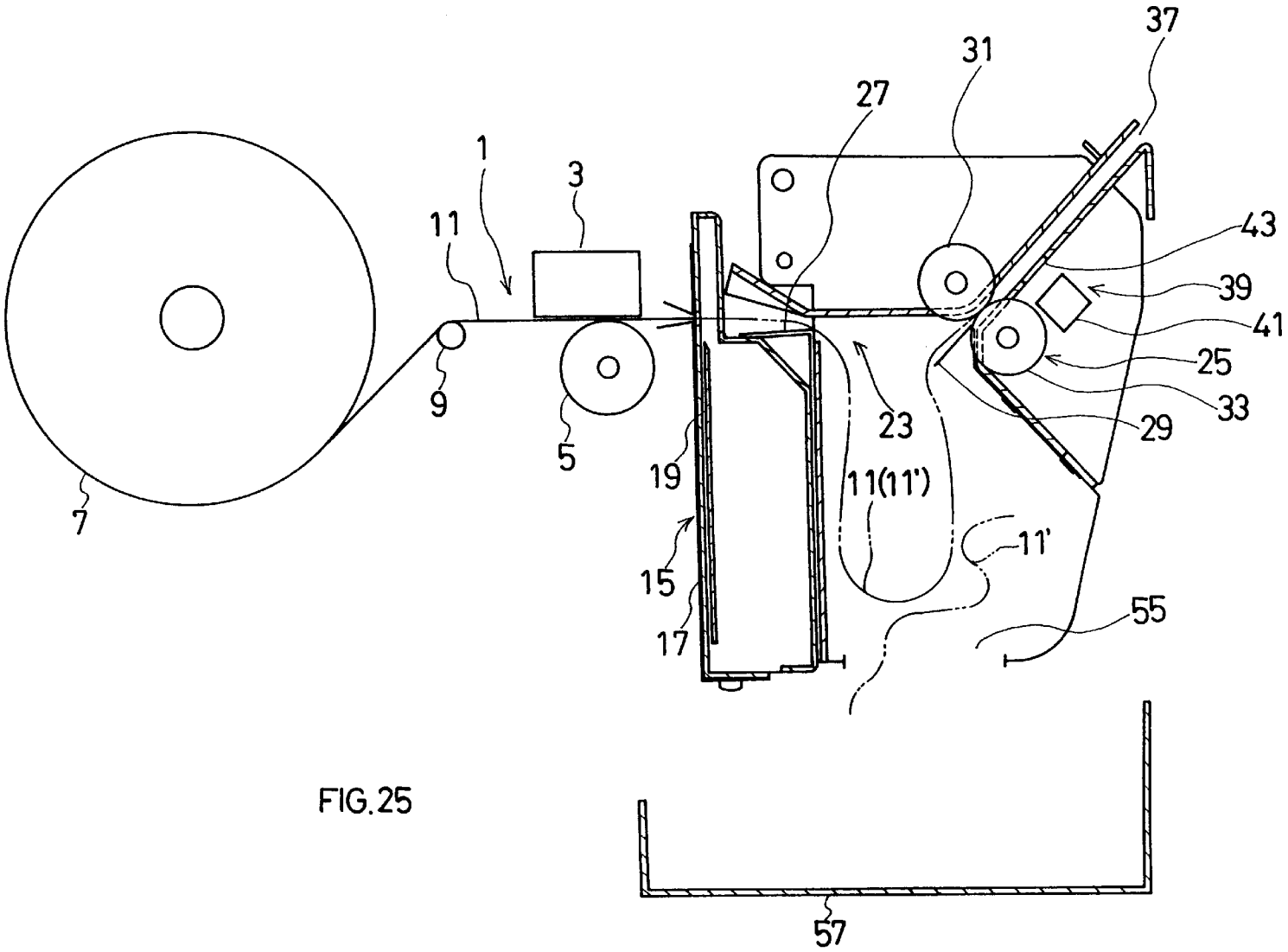
FIG. 25 is a view showing an operation of the paper discharging apparatus according to the second embodiment of the present invention.

Firstly, as illustrated in FIG. 24, the foregoing receipt 11' (the receipt positioned at the lower side in FIG. 24) has not been normally discharged, and returned to the space between the guide plates 27 and 29. In such a state, the dummy receipt 11' of which length is longer than that of the ordinary receipt (the receipt positioned at the upper side in FIG. 24) is issued. Thus the foregoing receipt 11' is pushed to be collected in the collection tray 57 via the opening 55, and the dummy receipt 11' drops and also collected in the collection tray 57 via the opening 55, as illustrated in FIG. 25.

Figure 26:
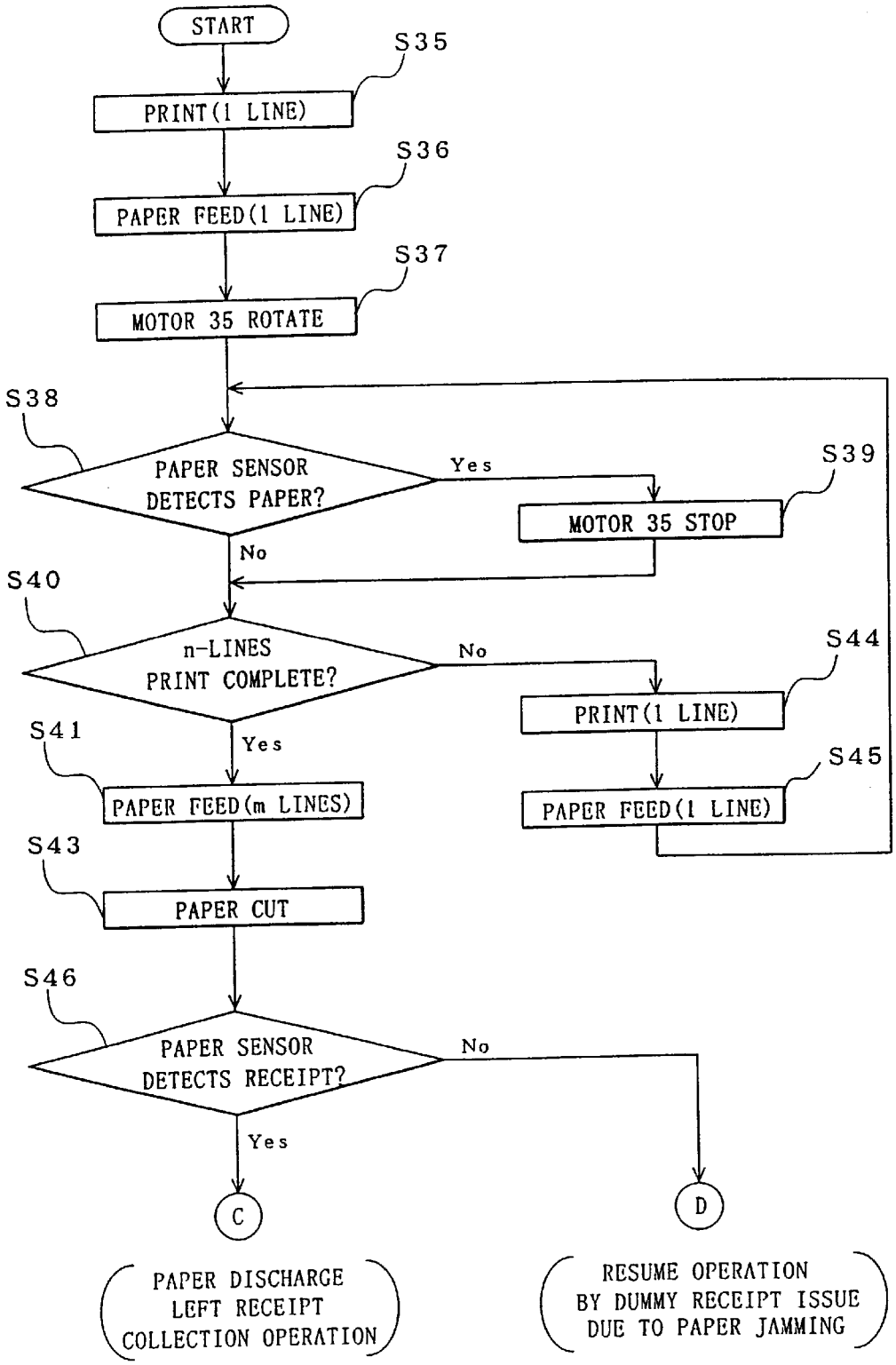
FIG. 26 is a flowchart showing an operation of the paper discharging apparatus according to the second embodiment of the present invention.

The above described operation of the second embodiment will be explained in order of operation with reference to flowcharts shown in FIGS. 26 through 28. The printing operation is firstly carried out as shown in FIG. 26. When the printing in one line is carried out (step S35), the paper is fed by one line (step S36). At the same time, the driving motor 35 rotates in order to rotatively drive the discharging roller 31 (step S37). Then control proceeds to step S38 to decide whether or not the paper sensor 41 detects the top of the paper 11. When the top of the paper 11 is detected by the paper sensor 41, control proceeds to step S39 to stop the driving motor 35. Therefore the driving motor 35 continues rotating until the top of the paper 11 is detected by the paper sensor 41.

Then control proceeds to step S40 to decide whether or not the printing in "n" lines (namely the predetermined printing as shown in FIG. 2) has been completed. When the printing has been completed, control proceeds to step S41 to execute the paper feed by "m" lines (see FIG. 2). Then control proceeds to step S43 at which the paper 11 is cut at the predetermined length by the cutting means 15 into the receipt 11'. To the contrary, if the printing in n lines has not been completed at step S40, control proceeds to step S44 to print in one line, then the paper feed by one line is carried out at step S45, and control returns to step S38.

Then control proceeds to step S46 to decide whether or not the paper sensor 41 detects the top of the receipt 11'. When the paper sensor 41 detects the top of the receipt 11', further operation as shown in the flowchart of FIG. 27 is executed. To the contrary, if the paper sensor 41 does not detect the top of the receipt 11', the operation as shown in the flowchart of FIG. 28 is executed.

Figure 27:
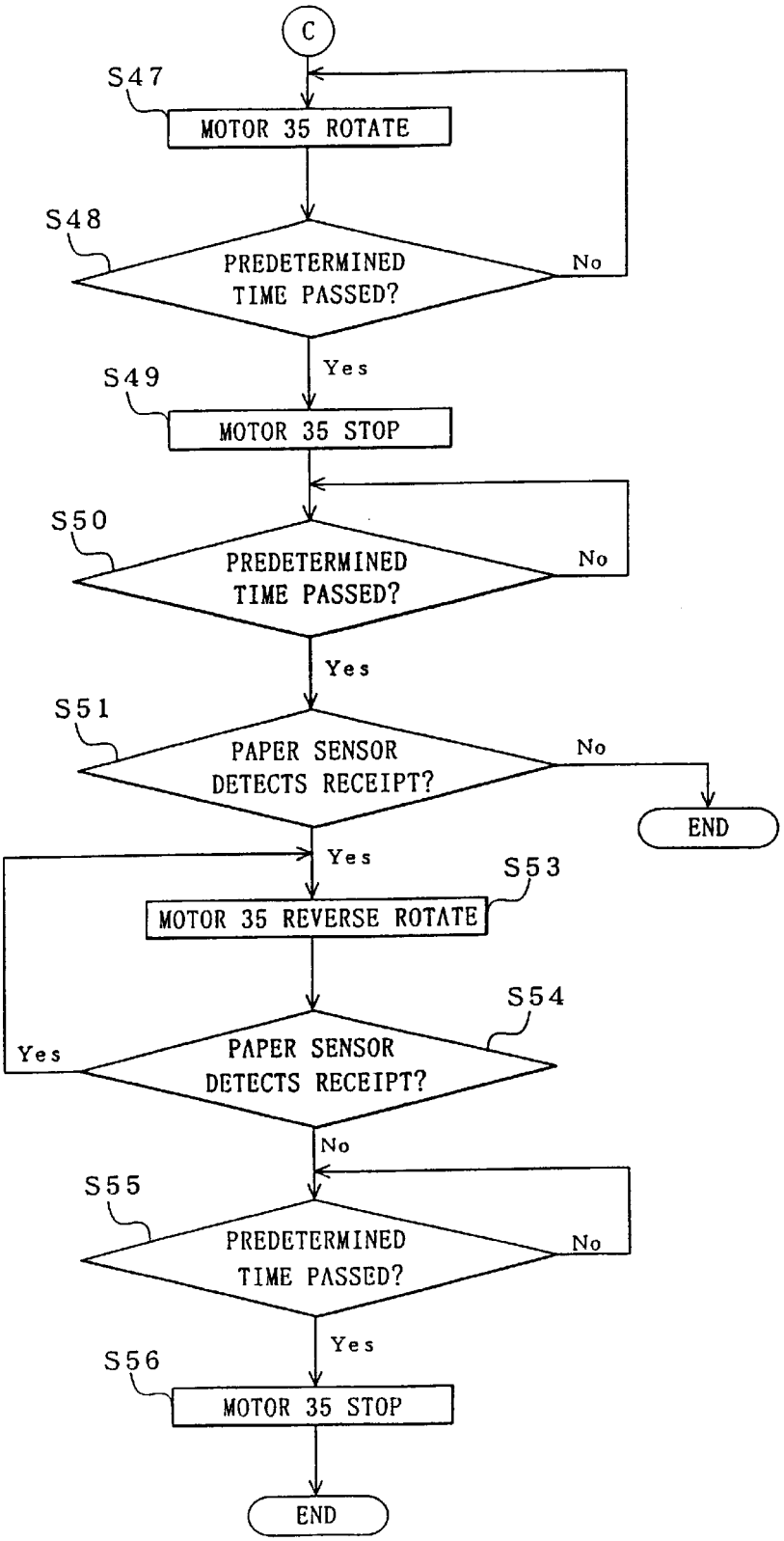
FIG. 27 is a flowchart showing an operation of the paper discharging apparatus according to the second embodiment of the present invention.
Figure 28:
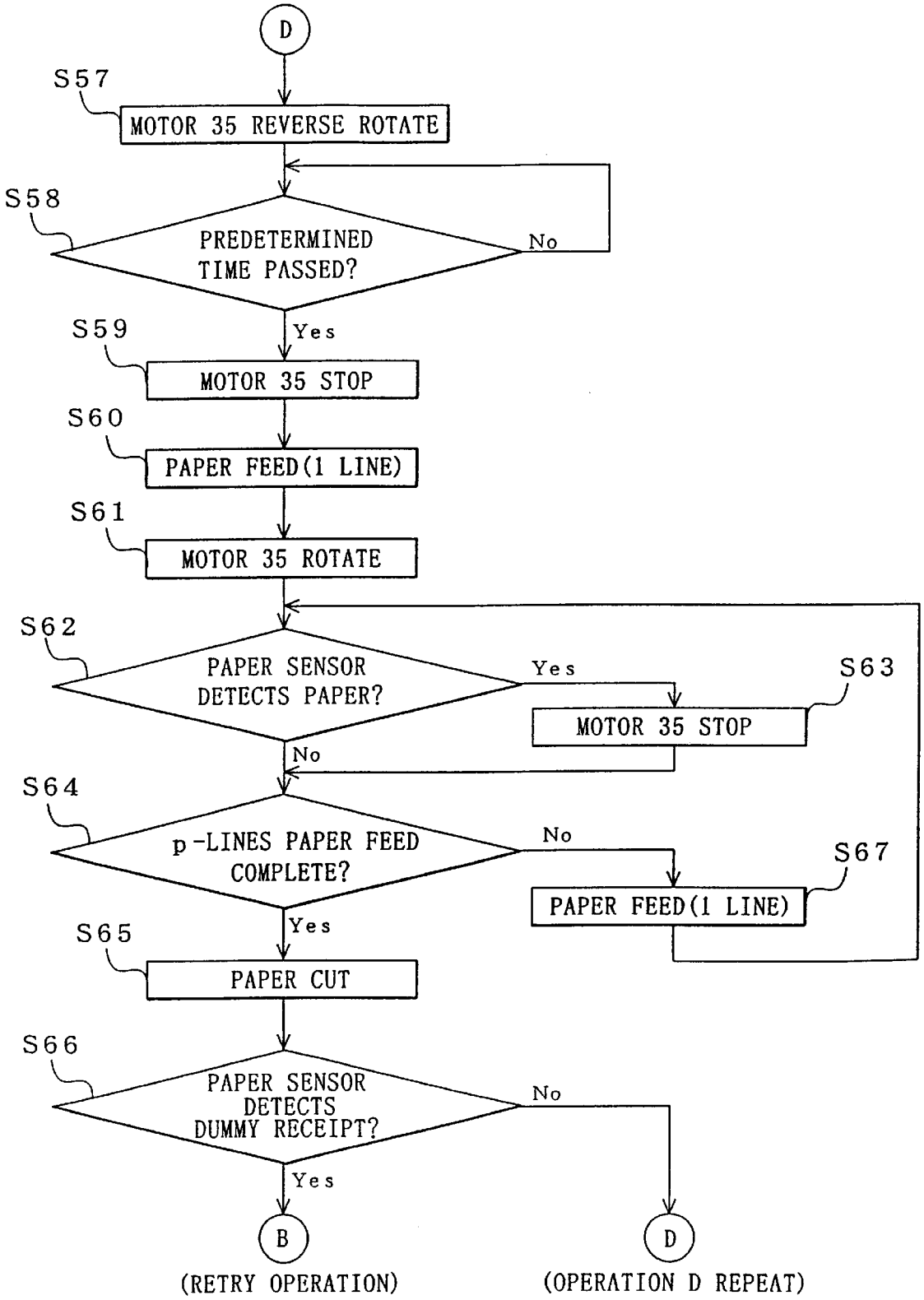
FIG. 28 is a flowchart showing an operation of the paper discharging apparatus according to the second embodiment of the present invention.

Firstly, in the case that the paper sensor 41 detects the top of the receipt 11', as shown in FIG. 27, the driving motor 35 rotates (step S47), and whether or not a predetermined time passed is decided (step S48). When the predetermined time of step S48 passed, control proceeds to step S49 to stop the driving motor 35. To the contrary, if the predetermined time of step S48 has not passed, control returns to step S47 to repeatedly execute the operations of steps S48 and S47. When the driving motor 35 stops, control proceeds to step S50 to decide whether or not a predetermined time passed. When the predetermined time of step S50 passed, then control proceeds to step S51 to decide whether or not the paper sensor detects the receipt 11'. To the contrary, when the predetermined time of step S50 has not passed, the decision at step S50 is repeatedly executed.

When the paper sensor 41 detects the receipt 11' at step S51, control proceeds to step S53 to rotate the driving motor 35 in the reverse direction. To the contrary, when the paper sensor 41 does not detect the receipt 11' at step S51, the normal paper discharge is considered to have been completed, and the operation ends. Namely, as long as the receipt 11' has normally been discharged, the receipt 11' cannot be detected by the paper sensor 41 at step S51, and if the receipt 11' is detected by the paper sensor 41 at step S51, the receipt 11' is considered not to be discharged in a normal state.

After the reverse rotation of the driving motor 35 at step S53, control proceeds to step S54 to decide whether or not the receipt 11' is detected again by the paper sensor 41. If the receipt 11' is still detected by the paper sensor 41, the driving motor 35 continues rotating in the reverse direction. When the receipt 11' is not detected at step S54, control proceeds to step S55 to decide whether or not a predetermined time passed. When the predetermined time of step S55 passed, control proceeds to step S56 to stop the driving motor 35. When the predetermined time of step S55 has not passed, the decision at step S55 is repeatedly executed until such a time passed. If the time passed, the receipt 11' is considered to be returned to the space between the guide plates 27 and 29.

Secondly, in the case that the paper sensor 41 does not detect the top of the receipt 11' at step S46 shown in the flowchart of FIG. 26, will now be described with reference to the flowchart of FIG. 28. In this case, the driving motor 35 rotates in the reverse direction (step S57). Then control proceeds to step S58 to decide whether or not a predetermined time passed. If the predetermined time of step S58 has not passed, the decision is repeatedly executed until the time passed. When the predetermined time of step S58 passed, control proceeds to step S59 to stop the driving motor 35. Then the paper feed by one line is carried out (step S60, in this case the printing is not carried out because of issue of the dummy receipt 11'), and the driving motor 35 rotates (step S61).

After that, control proceeds to step S62 to decide whether or not the paper sensor 41 detects the paper 11. When the paper 11 is detected, the driving motor 35 stops (step S63) When not detected, control proceeds to step S64 to decide whether or not the paper feed by "p" lines is carried out. The number of lines of paper feeding "p" is determined so as to be larger than the number of lines of paper feeding of the receipt 11' (1+n+m). When the paper feeding by p lines is carried out, control proceeds to step S65 to cut the paper 11. The thus cut paper 11 becomes the dummy receipt 11' which is longer than the jammed receipt 11'. Then control proceeds to step S66 to decide whether or not the paper sensor 41 detects the dummy receipt 11'. When the dummy receipt 11' is detected, control proceeds to the retry operation of the first embodiment of the present invention as shown in FIG. 23. To the contrary, if the dummy receipt 11' is not detected, control repeats the operation of FIG. 28.

In addition, when the paper feed by p lines is not carried out at step S64, the paper feed by one line is carried out at step S67, and control returns to step S62. Accordingly, the operations of steps S67, S62, (S63) and S64 are repeated until the paper feed by p lines has been completed.

As above described, according to the second embodiment of the present invention, in addition to obtaining the same effect as that of the first embodiment, the function of pressing down the receipt 11' (which has not been normally discharged and returned) toward the collection tray 57 is strengthened so as to be able to collect such a receipt without fail.

Third Embodiment

Figure 29:
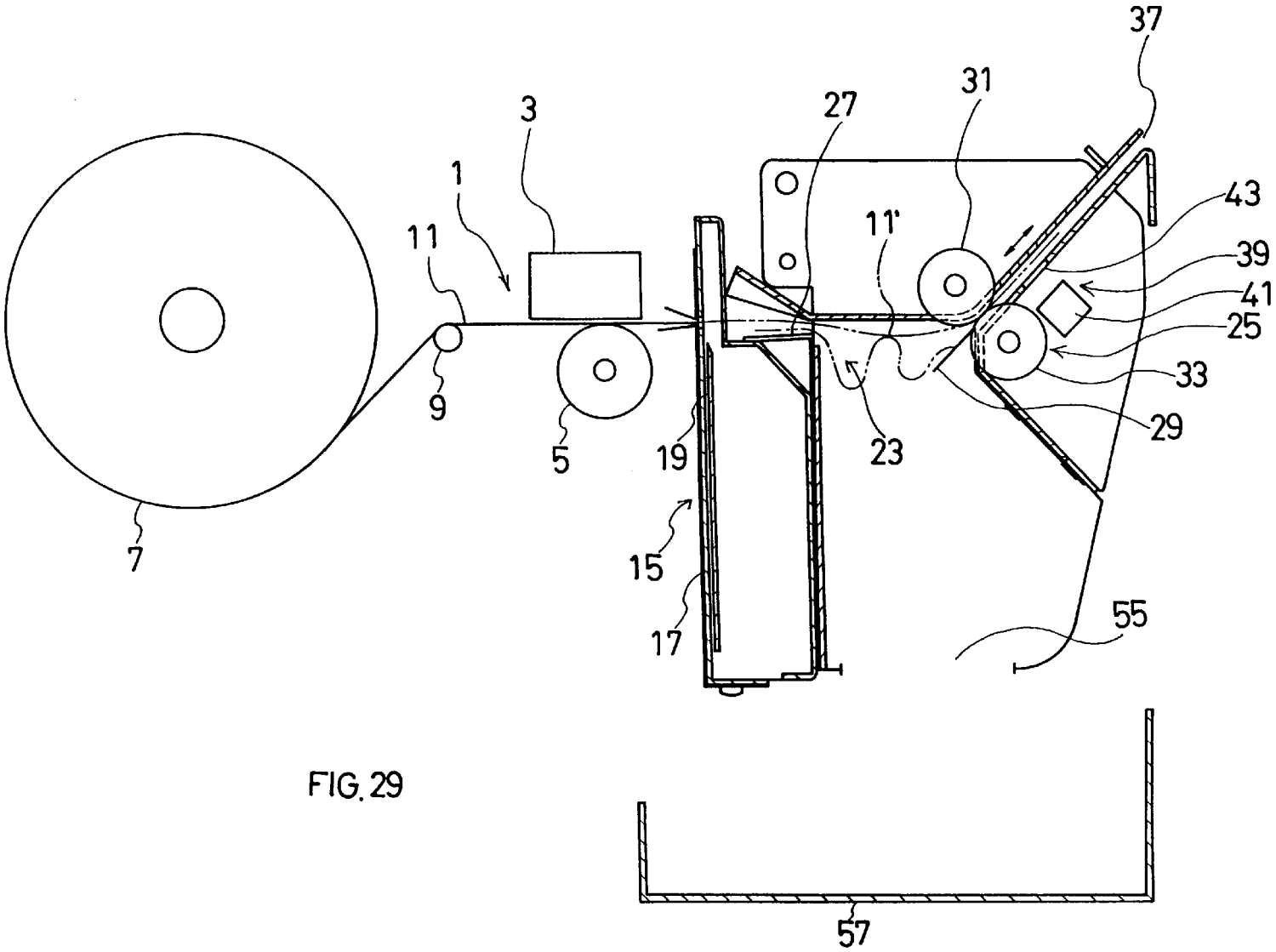
FIG. 29 is a view showing an operation of the paper discharging apparatus according to a third embodiment of the present invention.
Figure 30:
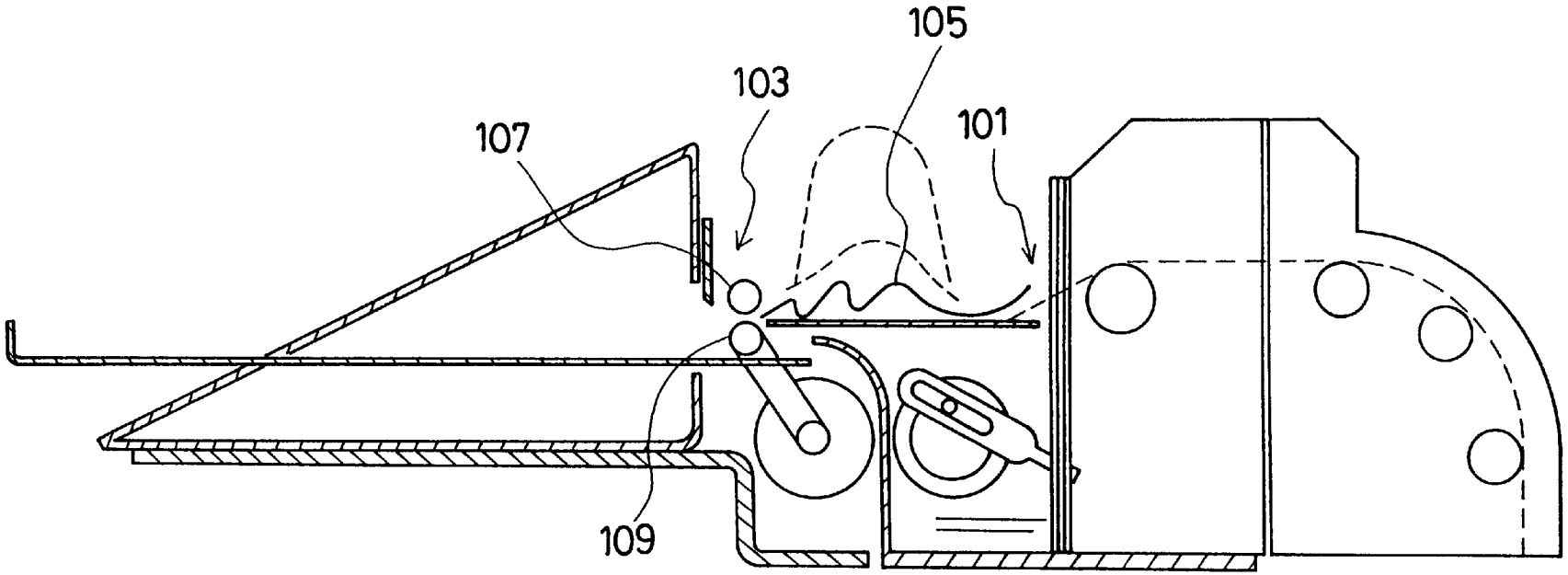
FIG.30 (PRIOR ART)
FIG. 30 is a view according to a prior art showing a structure of a paper discharging part of a printer.
Figure 31:
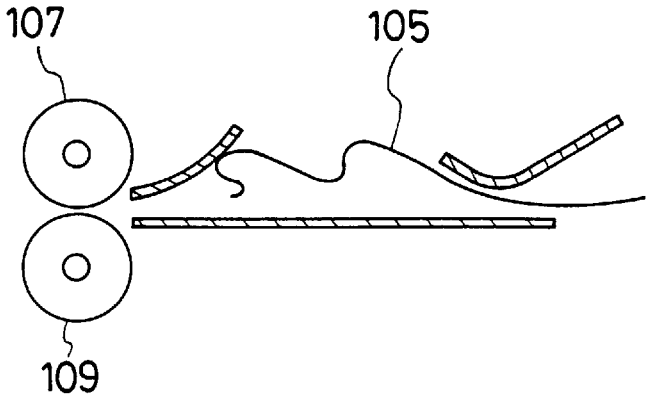
FIG. 31 is a side view showing a state when a paper creases and proper insertion between discharging rollers cannot be carried out.
Figure 32:
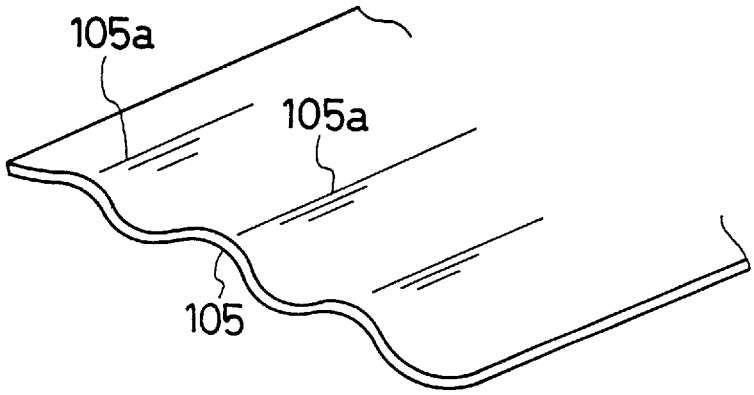
FIG. 32 is a perspective view showing a state that the paper creases.
Figure 33:
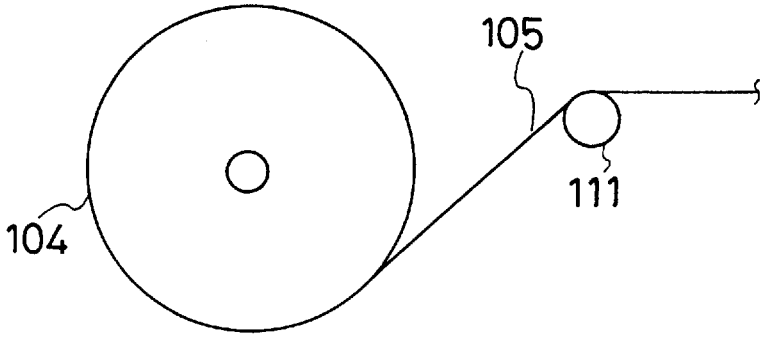
FIG. 33 is a side view showing a state that the paper curls according to the shape of a guide roller.
Figure 34:
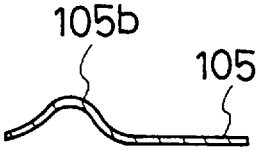
FIG. 34 is a side view showing a state that the paper curls.

A third embodiment of the present invention will now be described with reference to FIG. 29. In the third embodiment, like the case of the second embodiment, the dummy receipt 11' is issued in order to drop the receipt 11' which has not been normally discharged and returned to the space between the guide plates 27 and 29, so that the foregoing receipt 11' may be collected in the collection tray 57. However, the third embodiment has a character that the dummy receipt 11' is moved back and forth between the guide plates 27 and 29 by repeating forward and reverse rotations of the discharging rollers 31 and 33. Thus the foregoing receipt 11' which has not been discharged in a normal state is pushed to be collected by the collection tray 57 via the opening 55.

The present invention is not limited to the embodiments as described above.

Although the embodiments refer to the case of issue of receipt, the present invention can be of course applied to the apparatus which issues the similar printed matter such as ticket, etc.

What is claimed is:

1. A printer comprising:

printing means which performs predetermined printing on a paper;

cutting means which cuts the printed paper at a predetermined length;

paper discharging means which discharges the printed and cut paper from a paper outlet through a paper discharging route;

paper detecting means provided at the paper discharging route for detecting the paper to be discharged;

a paper collection part provided between the cutting means and the paper discharging means for storing the paper which is not discharged from the paper outlet; and controlling means for recognizing an occurrence of a paper jam when the paper is not detected by the paper detecting means after completion of the printing and cutting operations, the controlling means further returning the undischarged paper in a direction opposite to the paper discharging direction and causing another paper to be issued, thereby the returned undischarged paper being pushed by the issued another paper toward the paper collection part and collected therein.

2. The printer as claimed in claim 1, wherein, when the paper is detected by the paper detecting means after completion of the printing and cutting operations, the paper discharging operation is executed by the paper discharging means, and when the paper is still detected by the paper detecting means after an elapse of a predetermined time, the paper is returned in the direction opposite to the paper discharging direction to be collected in the paper collection part.

3. The printer as claimed in claim 1, wherein the issued another paper has the same printing done thereon as that of the undischarged paper.

4. The printer as claimed in claim 3, the controlling means repeats the paper issuing operation until the issued another paper is discharged from the paper outlet.

5. The printer as claimed in claim 1, wherein the issued paper is a dummy paper of which length is longer than that of the undischarged paper.

6. The printer as claimed in claim 5, the controlling means repeats the dummy paper issuing operation until the issued dummy paper is discharged from the paper outlet.

7. The printer as claimed in claim 5, wherein, when the dummy paper is detected by the paper detecting means, the controlling means recognizes the paper jam is eliminated and causes another paper to be issued, having the same printing done as that of the undischarged paper, and when the dummy paper is not detected by the paper detecting means, the controlling means recognizes that the paper jam is not eliminated and repeats the dummy paper issuing operation.

8. The printer as claimed in claim 5, wherein the paper discharging means includes discharge rollers, and the controlling means repeats forward and reverse rotations of the discharge rollers in order to push the undischarged paper toward the paper collection part by the issued dummy paper.

9. A paper collection system having a printing apparatus, a paper discharging apparatus and a paper collection apparatus comprising:

the printing apparatus including a printing head for printing on a paper and a cutter for cutting the printed paper;

the paper discharging apparatus located adjacent to the printing apparatus, including a paper discharger for discharging the printed and cut paper from a paper outlet through a paper discharging route, and further including a paper detector provided at the paper discharging route for detecting the paper to be discharged; and the paper collection apparatus located at the upstream of the paper discharging direction of the paper discharging apparatus, including a paper storage for collecting a jammed paper, and further including a controller for, in response to the status of the paper detector, returning the jammed paper toward the paper storage by the paper discharger and for causing the printing apparatus to issue another paper, thereby the jammed paper being pushed by the issued another paper toward the paper storage.

10. A printer comprising:

a printing head for printing on a paper;

a paper discharger for discharging the printed paper from a paper outlet through a paper discharging route;

a paper detector located on the paper discharging route for detecting the paper, a dummy paper issuing means for issuing a dummy paper to eliminate a jammed paper on the paper discharging route; and a paper collecting means for, in response to the status of the paper detector, causing the dummy paper issue means to issue a dummy paper to collect the jammed paper.

* * * * *